US007559757B2

(12) United States Patent
Correia

(10) Patent No.: US 7,559,757 B2
(45) **Date of Patent: *Jul. 14, 2009**

(54) BLOCK TEXTURE-MODIFYING APPARATUS AND METHOD

(75) Inventor: Horacio Correia, Lachenaie (CA)

(73) Assignee: Rinox Inc., Terrebonne, Quebec (CA)

( * ) Notice: Subject to any disclaimer, the term of this patent is extended or adjusted under 35 U.S.C. 154(b) by 544 days.

This patent is subject to a terminal disclaimer.

(21) Appl. No.: 10/547,657

(22) PCT Filed: Mar. 8, 2004

(86) PCT No.: PCT/CA2004/000345

§ 371 (c)(1),
(2), (4) Date: Dec. 8, 2005

(87) PCT Pub. No.: WO2004/078441

PCT Pub. Date: Sep. 16, 2004

(65) Prior Publication Data

US 2006/0269644 A1 Nov. 30, 2006

Related U.S. Application Data

(60) Provisional application No. 60/452,051, filed on Mar. 6, 2003.

(30) Foreign Application Priority Data

Aug. 28, 2003 (CA) ..... 2438808

(51) Int. Cl.
*B28B 11/08* (2006.01)

(52) U.S. Cl. ..... 425/385; 425/402; 425/403.1; 425/472; 264/293

(58) Field of Classification Search ..... 425/343, 425/385, 402, 403.1, 472; 264/293
See application file for complete search history.

(56) References Cited

U.S. PATENT DOCUMENTS

| | | | | |
|---|---|---|---|---|
| 1,229,582 | A * | 6/1917 | Butterworth | 264/145 |
| 1,825,938 | A * | 10/1931 | Brand | 425/343 |
| 1,888,376 | A * | 11/1932 | Duty | 425/343 |
| 6,109,906 | A * | 8/2000 | Castonguay et al. | 425/343 |
| 6,540,501 | B1 * | 4/2003 | Bott | 425/385 |
| 6,561,786 | B2 * | 5/2003 | Ciccarello | 425/343 |
| 6,575,727 | B2 * | 6/2003 | Ciccarello et al. | 425/343 |
| 6,793,476 | B2 * | 9/2004 | Bryja et al. | 425/145 |
| 6,994,081 | B2 * | 2/2006 | Pedersen et al. | 425/385 |

FOREIGN PATENT DOCUMENTS

| | | |
|---|---|---|
| EP | 1 211 036 | 5/2002 |

* cited by examiner

*Primary Examiner*—Yogendra Gupta
*Assistant Examiner*—Thu Khanh T Nguyen
(74) *Attorney, Agent, or Firm*—Ladas & Parry LLP

(57) ABSTRACT

A block texture-modifying apparatus for modifying the surface texture of blocks. The apparatus comprises a block support, a block-texture-modifying assembly and a translational movement assembly. The block support supports the blocks thereon. The block-texture-modifying assembly engages the blocks on the support. The translational movement assembly provides a translational movement between the blocks on the support and the block-texture-modifying assembly. The block-texture-modifying assembly acts on the blocks it engaged during this translational movement in order to modify their respective surface texture.

26 Claims, 25 Drawing Sheets

BLOCK TEXTURE-MODIFYING APPARATUS AND METHOD

CROSS REFERENCE TO RELATED APPLICATIONS

This application is a National Phase Entry application of International application No. PCT/CA 2004/000345 filed on Mar. 8, 2004 and published in English under PCT Article 21(2), this application claims priority on the foregoing PCT application as well as on U.S. provisional application No. 60/452,051, filed on Mar. 6, 2003 and on Canadian patent application No. CA 2,438,808 filed on Aug. 28, 2003. All documents above are herein incorporated by reference.

FIELD OF THE INVENTION

The present invention relates to blocks. More specifically, the present invention is concerned with a block texture-modifying apparatus for modifying the surface texture of blocks and a method therefor.

BACKGROUND OF THE INVENTION

Blocks made of cemententious material are well known. These blocks are made using pre-cast moulds. Such blocks can be used as building blocks, retaining wall blocks and the like.

There is a demand for such blocks with a used or worn and torn look giving one the impression that they have been cut from stone. Hence, blocks which have had their surface texture modified, such as having irregular edges or having being chipped, marked, scratched, abraded have become popular with consumers.

Conventional apparatuses are known as block tumblers. Blocks are placed in the tumbler and tumbled causing them to randomly scratch and chip each other in order to give them a "natural" or "used up" allure consumers are looking for.

A drawback with the conventional procedures and apparatuses for modifying the surface texture of blocks is that too much material is lost during the tumbling or chipping process making it an expensive process when considering material.

OBJECTS OF THE INVENTION

An object of the present invention is therefore to provide an improved block texture-modifying apparatus as well as a method for modifying the surface-texture of blocks.

SUMMARY OF THE INVENTION

More specifically, in accordance with the present invention, there is provided a block texture-modifying apparatus for modifying the surface texture of blocks, the apparatus comprising:

a block support for supporting blocks thereon;

a block-texture-modifying assembly for engaging the blocks on the support; and a translational movement assembly for providing a translational movement between the blocks on the support and the block-texture-modifying assembly;

wherein the block-texture-modifying assembly so acts on the blocks during the translational movement as to modify their respective surface texture.

In an embodiment, the block-texture-modifying assembly comprises at least one block-texture-modifying device.

In an embodiment, the block-texture-modifying device comprises a block-crunching device.

In an embodiment, the block-crunching device comprises a pair of top and bottom rollers, each of the rollers including ring-members along their respective lengths, the top and bottom being so spaced apart as to engageably receive the blocks therebetween during the translational movement.

In an embodiment, at least one of the top and bottom rollers is moveable so as to exert pressure to the blocks therebetween.

In an embodiment, the at least one of said top and bottom rollers is mounted to a moveable member for being moved thereby.

In an embodiment, the moveable member is mounted to expandable and contractible airpumps.

In an embodiment, the ring-members are expandable.

In an embodiment, each the top and bottom rollers comprise respective internal airpumps to expand the ring-members.

In an embodiment, each the top and bottom roller comprises at least one pair of adjacent ring-members, the pair of ring-members of a given the top or bottom roller engaging opposite edges of a given blocks, the ring-members so acting on the opposite edges of the block as to crunch them.

In an embodiment, the apparatus further comprises a plurality of adjacent pairs of the top and bottom rollers, wherein the respective pairs of ring-members for engaging opposite edges of a given pair of top and bottom rollers are shifted inwardly relative to the respective pairs of ring-members for engaging the same opposite edges of an upstream adjacent the pair of top and bottom rollers.

In an embodiment, each the top and bottom rollers are powered by an actuator so as to roll about their respective longitudinal axis.

In an embodiment, the block-texture-modifying device comprises an abrading device.

In an embodiment, the abrading device comprises a moveable abrader being spaced from the support so as to engage the blocks thereunder during the translational movement.

In an embodiment, the abrading device further comprises a block-lifting assembly beneath the moveable abrading-surface positioned at the support, for lifting the blocks during the translational movement.

In an embodiment, the block-lifting assembly comprises a roller including protrusions extending therefrom.

In an embodiment, the support comprises an opening the protrusions protruding from the support opening.

In an embodiment, the block-texture-modifying assembly comprises a plurality of block-texture-modifying devices positioned along different areas of the support.

In an embodiment, the translational movement assembly comprises a block displacement assembly for displacing the block along the support and through the different areas.

In an embodiment, at least one of the block-texture-modifying devices comprises at least one block-crunching device and at least another of the block-texture-modifying devices comprises a block-abrading device.

In an embodiment, the translational movement assembly comprises a block-displacement assembly.

In an embodiment, the block-displacement device comprises a push-member for pushing the blocks along the support, the push-member being powered by a push-member actuator for translational movement thereof.

In an embodiment, the push-member comprises a proximal end mounted to the push-member actuator and a distal end for engaging and pushing the blocks during the translational movement.

In an embodiment, the push-member is pivotally mounted to the push-member actuator for pivotal movement thereof.

In an embodiment, the texture-modifying assembly comprises a block-chipping assembly.

In an embodiment, the block-chipping assembly comprises at least one block-chipping device to so engage the blocks thereunder during the translational movement as to chip the blocks.

In an embodiment, the block-chipping assembly comprises block-lifting assembly at the support, the block-chipping assembly being spaced above the block-lifting assembly, the block-lifting assembly lifting the blocks during the translational movement.

In an embodiment, the block-lifting assembly comprises a roller, the roller including cam members disposed thereon, the cam members configured to so lift the blocks displaced on the roller when rolling and during the translational movement that the blocks engage the chipping-assembly to be chipped thereby.

In an embodiment, the block-lifting assembly comprises liftable finger-members contiguous with the support and a finger-actuator for lifting the finger-members, the liftable finger-members lifting the blocks thereon when actuated during the translational movement so as to be engaged by the chipping assembly.

In an embodiment, the finger-actuator comprises a roller positioned under the finger-members, the roller including cam members for lifting the finger-members during rolling of the roller In an embodiment, the finger-members are positioned side by side and hinged at a common end to a support member.

In an embodiment, the block displacement device comprises a conveyor.

In an embodiment, the conveyor comprises a conveying-surface mounted at each end thereof to opposite rollers.

In an embodiment, the conveying-surface is disposed along the support.

In an embodiment, the conveying-surface comprises a pair of conveying belts and a block-engaging member being mounted at each end thereof to a respective conveying belt of the pair of conveying belts for displacing the blocks during the translational movement.

In an embodiment, the conveying surface comprises a conveyor carpet including a block-engaging elements extending therefrom for displacing the blocks during the translational movement, the conveyor carpet defining an opening adjacent to the block-engaging element.

In an embodiment, the block chipping device comprises a mobile-member including chipping elements, the mobile-member providing for the chipping elements to so movingly engage the blocks as to chip the blocks during the translational movement.

In an embodiment, the mobile-member comprises a longitudinal rotating-member defining an axis of rotation and powered by a rotation-actuator so as to rotate about the axis of rotation.

In an embodiment, the chipping elements comprise chains.

In an embodiment, the chipping-elements comprise protrusions.

In an embodiment, the longitudinal rotating-member is further rotatable about a second axis of rotation being generally orthogonal to the axis of rotation defined by the longitudinal rotating-member.

In an embodiment, the longitudinal rotating member is powered by a second rotation-actuator so as to be rotated thereby about the second axis of rotation.

In an embodiment, the rotation-actuator comprises a bracket member, the longitudinal rotating-member mounted to the bracket member.

In an embodiment, the chipping device comprises moveable hammering-members for hammering the blocks thereunder during the translational movement.

In an embodiment, the hammering-members comprise a respective hammer-head and another opposite end hingeably mounted to a support, the chipping device further comprising a rotating member including cams, the opposite end of each of the hammering elements configured to be so engaged by the cams during rotation of the rotating member as to cause a respective the hammering element to move so as to engage and chip the blocks thereunder during the translational movement.

In an embodiment, the block-texture-modifying device comprises an abrading device for abrading the displaced blocks during the translational movement.

In an embodiment, the abrading device comprises a drum-roller powered by a drum-roller-actuator for rotation thereof.

In an embodiment, the block-texture-modifying device comprises a hammering device, the support comprising opposite lateral sides, the hammering device including mobile-hammer members at each the lateral support side to hammer the blocks during the translational movement.

In an embodiment, each hammer member comprises a reciprocating member mounted at one end to a hammer-actuator and having a hammerhead on its opposite free end.

In an embodiment, the apparatus further comprises a controller linked to the block-texture-modifying device and said translational movement assembly so as to receive data therefrom and for control therefor.

In an embodiment, the controller comprises an interface for providing viewing of the data.

In an embodiment, the support is defined by the block-texture-modifying assembly, the block-texturing-modifying assembly comprising a moveable surface including block-texture-modifying elements, the translational movement assembly displacing the blocks during the translational movement on the mobile surface during movement thereof.

In an embodiment, the moveable surface is defined by rollers, the block-texture-modifying elements comprising protrusions extending from the rollers, the blocks being displaceable on the moveable surface during rotation of the rollers so as to be chipped by the protrusions.

In an embodiment, the translational movement assembly comprises a conveyor spaced above the moveable surface and including block-engaging elements extending therefrom for displacing the blocks along the moveable surface during the translational movement.

In an embodiment, the translational movement assembly comprises a push-member for mounted to an actuator at one end for translational movement thereof and having an opposite free end including a block-engaging member for engaging the blocks during the translational movement.

In an embodiment, the block-texture-modifying assembly is spaced above the support, the translational movement assembly configured to move the block-texture-modifying assembly along the length of the support during the translational movement.

In accordance with an aspect of the present invention there is provided a block-texture-modifying device for modifying the surface texture of blocks, the device comprising:

a pair of spaced apart top and bottom rollers for engaging a block therebetween, ring-members disposed along the length of each the top and bottom roller; and a rolling actuator to roll the top and bottom rollers about their respective longitudinal axis wherein when the blocks are positioned between the top and bottom rollers, the ring-members engaging the blocks, the rollers so rolling as to cause the ring-members to modify the surface texture of the blocks.

In an embodiment, at least one of the top and bottom rollers is moveable so as to exert pressure to the blocks therebetween.

In an embodiment, the at least one of said top and bottom rollers is mounted to a moveable member for being moved thereby.

In an embodiment, the moveable member is mounted to expandable and contractible airpumps.

In an embodiment, the ring-members are expandable.

In an embodiment, each the top and bottom rollers comprise respective internal airpumps to expand the ring-members.

In an embodiment, each top and bottom roller comprises at least one pair of adjacent ring-members, the pair of ring-members of a given top or bottom roller engaging opposite edges of a given block, the ring-members so acting on the opposite edges of the block as to modify their surface texture.

In an embodiment, the device comprises a plurality of adjacent pairs of the top and bottom rollers, wherein the respective the pairs of ring-members for engaging opposite edges of a given the pair of top and bottom rollers are shifted inwardly relative to the respective the pairs of ring-members for engaging the same opposite edges of an upstream adjacent the pair of top and bottom rollers.

In an embodiment, the device comprises a moveable abrader, wherein the blocks are positioned beneath the moveable abrader so as to be engaged thereby, the abrader being so moved as to modify the surface texture of the blocks it engages.

In an embodiment, the device further comprises a block lifting-assembly beneath the moveable abrader, the blocks being positioned on the block lifting assembly to be lifted thereby against the abrader during the movement thereof.

In an embodiment, the block-lifting assembly comprises a roller including protrusions extending therefrom.

In an embodiment, the abrader is spring biased towards the block-lifting assembly.

In accordance with an aspect of the invention there is provided a block texture-modifying apparatus for modifying the surface texture of blocks, the apparatus comprising:

a block displacement surface for displacing the blocks thereon;

a block-texture-modifying assembly for engaging the blocks on the displacement positioned at the displacement surface; and a block-displacement assembly for providing a displacing the blocks on the support through the block-texture-modifying assembly;

wherein the block-texture-modifying assembly so acts on the blocks during the displacement therethrough as to modify their respective surface texture.

In an embodiment, the block-texture-modifying assembly comprises a block-crunching device.

In an embodiment, the block-texture-modifying assembly comprises an abrading device.

In an embodiment, the block-texture-modifying assembly comprises a block-crunching device and an abrading device.

In an embodiment, the displacement assembly is a push-member for pushing the blocks on the displacement surface.

In accordance with an aspect of the invention there is provided a block texture-modifying apparatus for modifying the surface texture of blocks, the apparatus comprising:

a block displacement surface including in-feed and out-feed ends, first and second lateral sides and a block-lifting assembly;

a block-displacement assembly for displacing the blocks along the displacement surface and the block-lifting assembly; and a block-chipping device spaced above the block-lifting assembly and including block-chipping elements;

wherein when the blocks are displaced along the block-lifting assembly, the block-lifting assembly is so configured as to lift the blocks so that the lifted blocks contact the chipping elements to be chipped thereby.

In an embodiment, the displacement-surface comprises an opening, the block-lifting assembly being positioned at the opening.

In an embodiment, the block-lifting assembly is contiguous to the displacement-surface.

In an embodiment, the block-lifting assembly comprises a roller, the roller including cam members disposed thereon, the cam members configured to lift the blocks displaced on the roller during rolling thereof so that the blocks contact the chipping elements.

In an embodiment, the block displacement assembly comprises a flat-board assembly, the flat-board assembly including liftable finger members and a flat-board actuator assembly, the flat-board members configured to lift the blocks displaced thereon when actuated by the flat-board actuator assembly so that the blocks contact the chipping elements.

In an embodiment, the finger-member actuator assembly comprises a roller positioned under the finger-members, the roller including cam members disposed thereon, the cam members configured to lift the-finger-members during rolling thereof.

In an embodiment, the finger members are positioned side by side and hinged to a support member.

In an embodiment, the block displacement assembly comprises a conveyor assembly.

In an embodiment, the conveyor belt mounted at each end thereof to opposite rollers respectively positioned near the in-feed and out-feed ends, the conveyor belt including an opening for allowing direct contact between the block-lifting assembly and the blocks.

In an embodiment, the conveyor belt comprises block-engaging elements extending therefrom and configured to engage and pushingly displace the blocks when the belt is conveyed.

In an embodiment, the conveyor assembly comprises first and second belts positioned at the first and second lateral sides of the displacement surface respectively, each of the first and second belts being mounted at each end thereof to opposite rollers respectively positioned near the in-feed and out-feed ends.

In an embodiment, the conveyor assembly comprises block-engaging elements, each of the block-engaging elements being the mounted to both first and second belts and configured to engage and pushingly displace the blocks when the first and second belts are mutually conveyed.

In an embodiment, block chipping device comprises a chipping-member having the chipping elements mounted thereon, the chipping-member defining a spinning axis and being so configured as to spin the chipping-elements about the spinning axis causing the chipping-elements to strike the blocks in contact therewith.

In an embodiment, the block-chipping device comprises a spinning-actuator mounted to the chipping-member for spinning the chipping member about its spinning axis.

In an embodiment, the chipping member is a longitudinal rotating member with the chipping elements extending therefrom.

In an embodiment, the chipping-elements include chains members.

In an embodiment, the chain members comprise weights on their free ends.

In an embodiment, the chipping-elements include protrusion members.

In an embodiment, the block chipping apparatus further comprises a rotation-assembly mounted to the chipping-member, the chipping-member having an axis of rotation generally orthogonal to the spinning axis, the rotation-assembly configured to rotate the chipping-member about the axis of rotation.

In an embodiment, the chipping member is a longitudinal roller-member, the rotation-assembly including an actuator assembly mounted to a bracket, the bracket mounted at each longitudinal end of the roller-member, the actuator assembly configured to rotate both the bracket and the roller-member about the axis of rotation.

In an embodiment, the chipping apparatus comprises moveable hammering-members for hammering the surface of the blocks in contact therewith.

In an embodiment, the hammering elements comprise a respective hammer-head and another opposite end hingeably mounted to a support, the apparatus further including a rotating member having cams, the opposite end of each of the hammering elements configured to be so engaged by the cams during rotation of the rotating member as to cause a respective the hammering element to move.

In an embodiment, the assembly further comprises an abrading assembly positioned near the out-feed end, the abrading assembly including abrading-elements for abrading the surface of the displaced blocks.

In an embodiment, the abrading-elements include a drum-roller configured to directly roll on the surface of the displaced blocks for abrading the block surfaces.

In an embodiment, the drum roller is mounted to an actuator for rotation thereof.

In an embodiment, the drum-roller is made of material selected from the group consisting of: concrete, cement and metal.

In an embodiment, the apparatus further comprises a hammering-assembly including first and second opposite hammer-members positioned at the first and second lateral sides of the displacement surface respectively, the hammer-members configured to hammer the displaced blocks.

In an embodiment, the hammering-assembly comprises an actuator for each the hammer-member.

In an embodiment, each of the hammering-members include a reciprocating arm-member mounted at one end to the actuator and having a hammerhead at its free end for hammering the displaced blocks.

In an embodiment, the assembly further comprises a controller linked to the block-lifting assembly, the block displacement assembly and the block chipping apparatus so as control the block-lifting assembly, the block displacement assembly and the block chipping apparatus to receive data therefrom.

In accordance with an aspect of the invention there is provided a block texture-modifying apparatus for modifying the surface texture of blocks, the apparatus comprising:

a block chipping device including a longitudinal chipping surface, the chipping surface including chipping elements, the chipping surface being so configured as to move the chipping elements; and a block displacement assembly for displacing the blocks along the longitudinal chipping surface;

wherein when the blocks are displaced along the chipping surface the block chipping elements are so moveable as to chip the blocks when in contact therewith.

In an embodiment, the chipping device is a longitudinal roller defining a longitudinal axis of rotation and including the chipping surface about its periphery, the roller being so rotatable about the axis as to cause the chipping elements to strike and chip the displaced blocks.

In an embodiment, the rotatable movement of the longitudinal roller is a reciprocal partial rotation.

In an embodiment, the rotatable movement of the longitudinal roller is a rotation about the axis.

In an embodiment, the chipping device comprises a plurality of the longitudinal rollers positioned side by side.

In an embodiment, the chipping elements are protrusion members protruding from the chipping surface.

In an embodiment, the block displacement assembly comprises a conveyor assembly positioned above the chipping surface, the conveyor assembly including a belt mounted on opposite end rollers, the belt including block displacement elements extending therefrom, the block displacement elements configured to engage and pushingly displace the blocks along the chipping surface when the belt is conveyed.

In an embodiment, the apparatus further comprises a controller being so configured and inked to the block chipping apparatus and to the block displacement assembly as to receive and analyse data therefrom and to control the block chipping apparatus and to the block displacement assembly.

In accordance with an aspect of the invention, there is provided a block texture-modifying apparatus for modifying the surface texture of blocks, the apparatus comprising:

a block displacement surface;

a block-texture-modifying assembly comprising:

an inferior sub-block-modifying assembly defining at least a portion of the block displacement surface, the surface comprising chipping elements for chipping the surface of the blocks displaced thereon; and a superior sub-block modifying assembly spaced above the block displacement surface for engaging blocks thereunder; and a block displacement assembly for displacing the blocks on the displacement surface.

In an embodiment, the apparatus further comprises a block-crunching device.

In an embodiment, the inferior sub-block-modifying assembly comprises rotatable rollers including protrusion extending therefrom.

In an embodiment, the superior sub-block modifying assembly is selected from the group consisting of a block-chipping device, an abrading device and a combination thereof.

In accordance with an aspect of the invention there is provided a block texture-modifying system for modifying the surface texture of blocks, the system comprising:

a block support for supporting blocks thereon;

a block-texture-modifying assembly for engaging the blocks on the support;

a translational movement assembly for providing a translational movement between the blocks on the support and the block-texture-modifying assembly; and a controller linked to the block-texture-modifying assembly and the translational movement assembly for receiving data therefrom and transmitting a control signal thereto.

wherein the block-texture-modifying assembly so acts on the blocks during the translational movement as to modify their respective surface texture.

In an embodiment, the system further comprises sensors so positioned as to sense the position of the blocks on the support and to transmit this data to the controller.

In an embodiment, the controller comprises an interface for providing the viewing of the data.

In accordance with an aspect of the invention there is provided a method for modifying the surface texture of blocks, displacing the blocks on a displacement surface impacting the displaced blocks with top pressure so as to modify their respective surface texture.

In an embodiment, impacting comprises randomly lifting the displaced blocks against the top pressure.

In an embodiment, the method further comprises displacing the blocks on the surface comprising chipping elements that impact the surface of the block so as to chip it.

In an embodiment, the method further comprises impacting the displaced blocks with pressure on the lateral sides of the blocks.

Other objects, advantages and features of the present invention will become more apparent upon reading of the following non-restrictive description of embodiments thereof, given by way of example only with reference to the accompanying drawings.

BRIEF DESCRIPTION OF THE DRAWINGS

In the appended drawings where like elements are referenced by like reference numerals and in which.

DESCRIPTION OF THE EMBODIMENTS

With reference to the appended drawings embodiments of the invention will be herein described so as to exemplify the invention only and not limit the scope thereof.

With reference to FIGS. 1 to 10 an embodiment of the present invention will be herein described.

Figure 1:
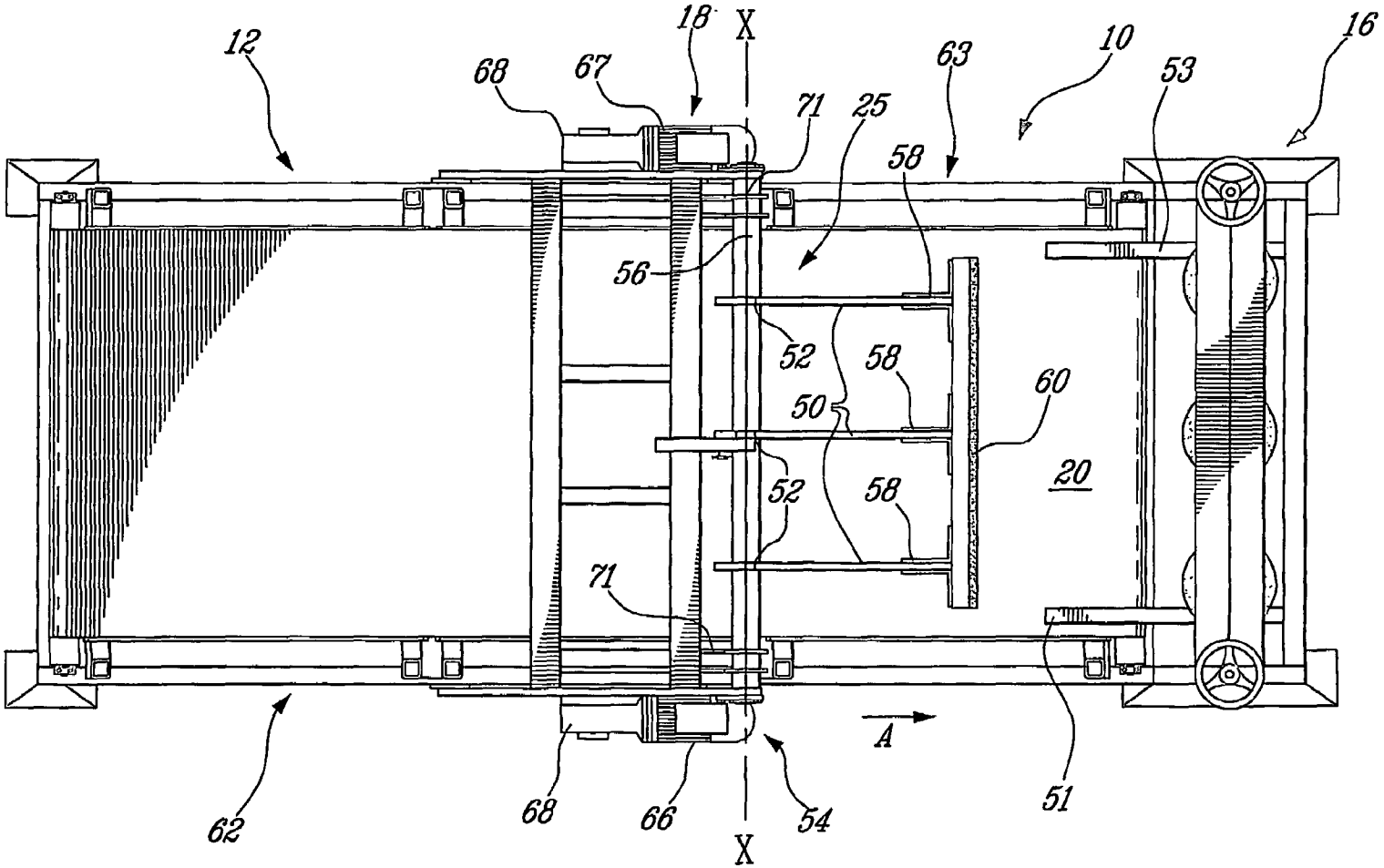
FIG. 1 is a top plan view of a block texture modifying apparatus 10 in accordance with an embodiment of the present invention.
Figure 2:
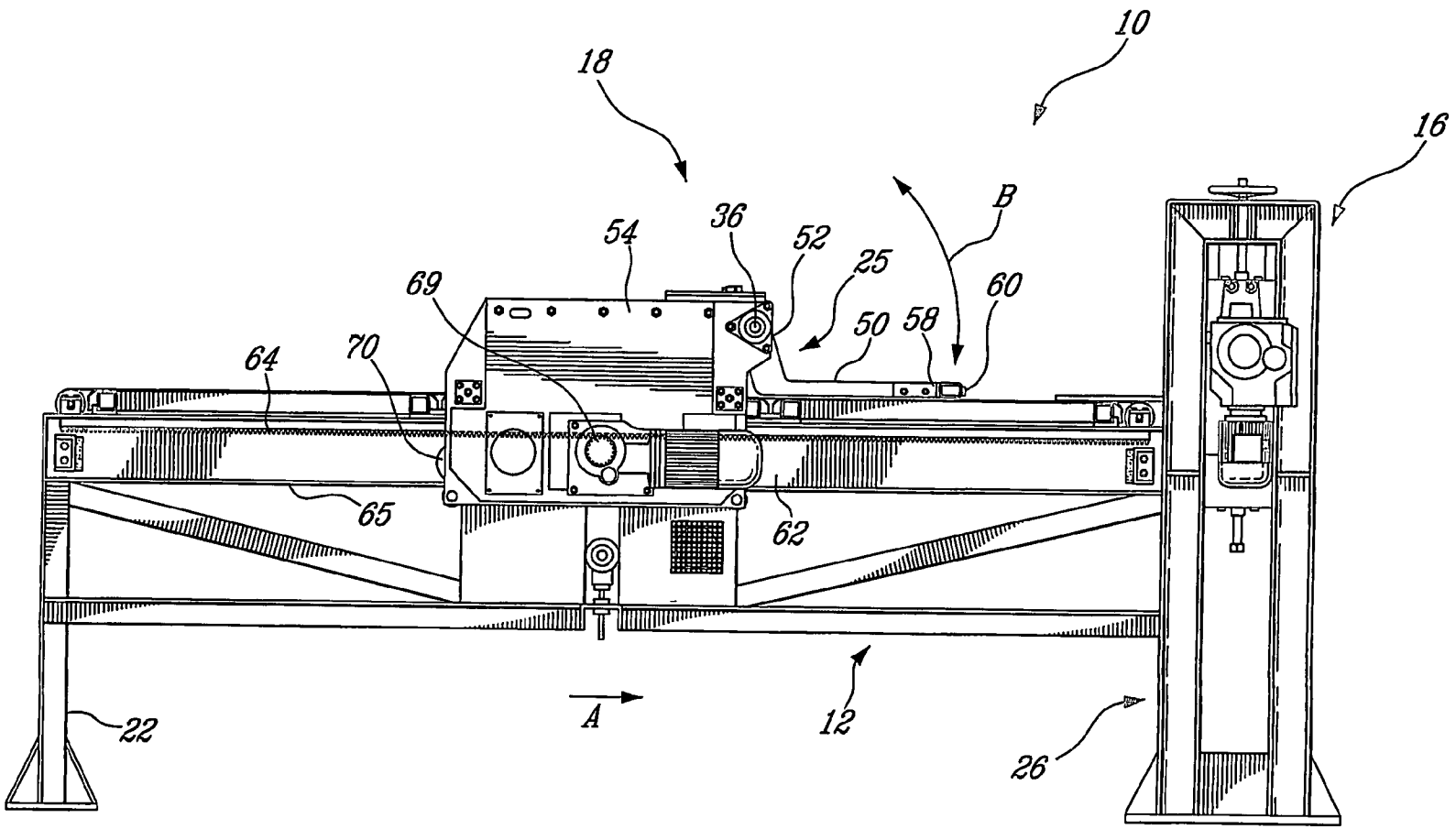
FIG. 2 is a lateral elevational view of the apparatus of FIG. 1.

FIGS. 1 and 2 show a block texture modifying apparatus 10 for modifying the surface texture of blocks 14 (see FIGS. 4-11, 13, and 16-28) in accordance with an embodiment of the present invention.

Blocks 14 comprise building blocks, pavement blocks, retaining wall blocks, slabs, cemententious blocks, pre-cast blocks, granite blocks, marble blocks and the like.

The expression "modifying the surface texture of blocks" should be construed herein to comprise without limitation: cracking, chipping, scratching, marking, wearing, cuffing, abrading, brittling, scathing, hammering, polishing or otherwise impacting the surface of the blocks 14 so as to mechanically produce an irregularity in their surface texture.

Apparatus 10 comprises a block support 12 for supporting blocks 14 thereon. Apparatus 10 also comprises a block-texture-modifying assembly 16 for engaging the blocks 14 on support 12 so as to modify their surface texture and a translational movement assembly 18 which provides for a translational movement between the blocks 14 on support 12 and the block texture modifying assembly 16, as will be explained herein.

Support 12 is comprises a substantially flat surface 20 (see FIG. 1) being spaced from the ground by leg members 22 (see FIG. 2). As will be explained herein, the flat surface 20 acts as a block displacement surface.

Figure 3:
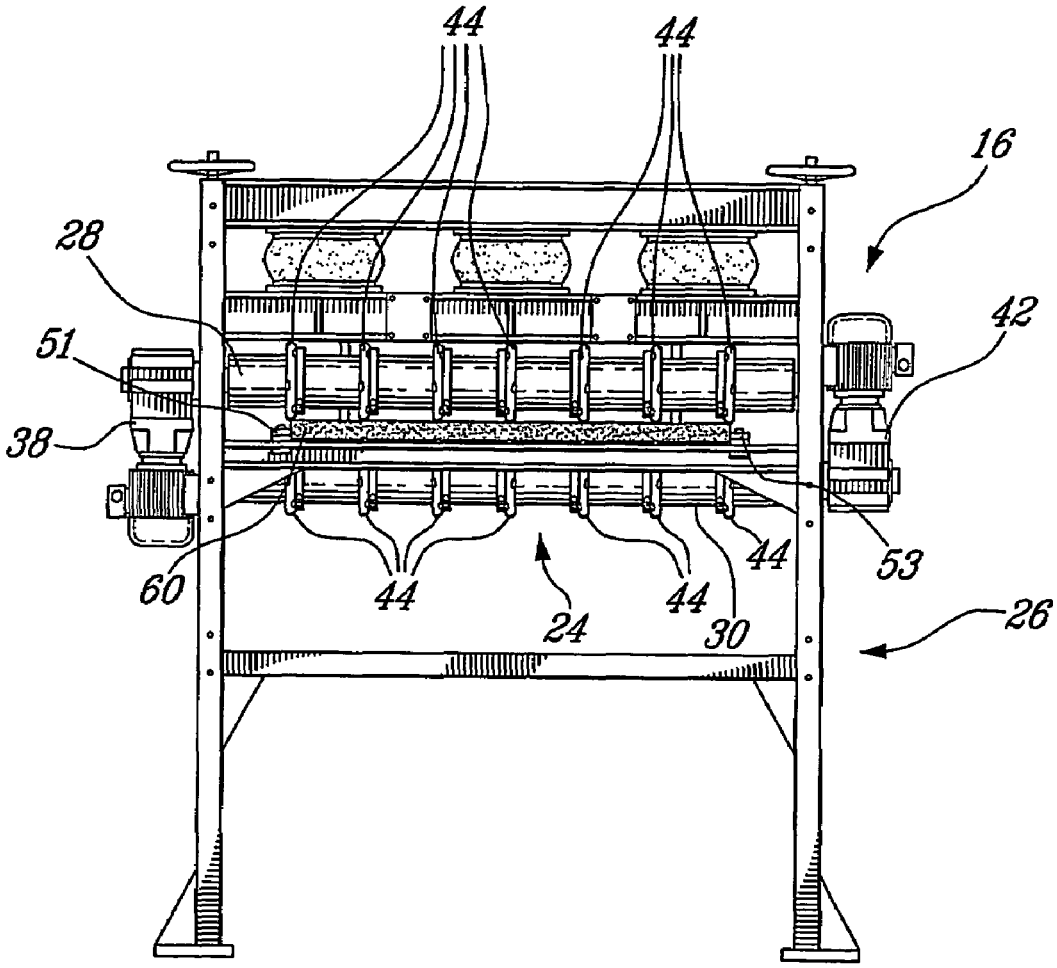
FIG. 3 is a front elevational view of the apparatus of FIG. 1.
Figure 4:
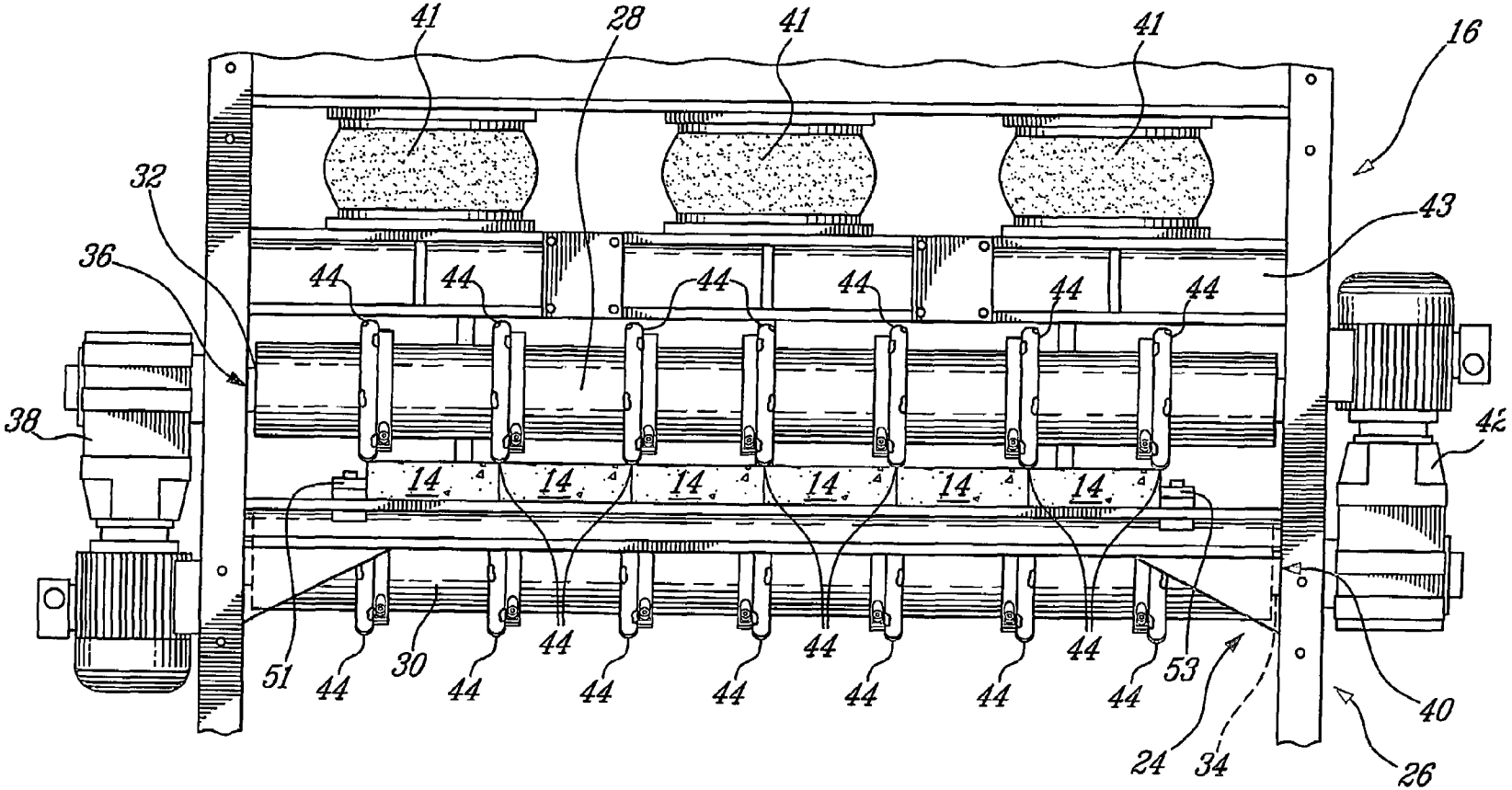
FIG. 4 is a front elevational view similar to FIG. 3 showing blocks having their surface textures modified.

As better shown in FIGS. 3 and 4, the block-texture-modifying assembly 16 comprises a block-texture-modifying device 24 in accordance with an embodiment of the present invention. In another embodiment, the block-texture-modifying assembly 16 may comprise a plurality of block-texture-modifying devices 24.

Device 24 is a block-crunching or block edge-wearing device and includes a support unit 26 mounted to support 12 (as shown in FIG. 2) and a pair of similarly constructed top and bottom rollers 28 and 30 rotatably mounted to the support unit 26.

The top and bottom rollers 28 and 30 include respective rotary actuators 32 and 34. Each rotary actuator 32, 34 has respective opposite longitudinal ends extending through the top and bottom rollers 28, 30 respectively. Each longitudinal end of the rotary actuators is rotatably mounted to the support unit 26 as will be understood by the skilled artisan. Furthermore, one of the longitudinal ends 36 (whose location is shown in FIG. 4) of rotary actuator 32 is mounted to top motor 38; similarly one of the longitudinal ends 40 of (whose location is shown in FIG. 4) is mounted to a bottom motor 42. In this way, rotary actuators 32 and 34 are powered by top and bottom motors 38 and 42 respectively to rotate the rollers 28, 30 in the direction of the translational movement as will be explained herein. Motors 38 and 42 are mounted to the support unit 26.

Rollers 28, 30 include ring-members 44 which can be in the form of discs and which are disposed along their length. Two adjacent ring members 44 of a given top or bottom roller 28, 30 are spaced apart by a distance which is determined by the distance of any two of the opposite lateral sides 45 of a given block 14 (better shown in FIGS. 4, 5, 6 and 11) and in this way the crunching device 24 acts as block-edge wearing device acting on the top and bottom edges 47 of the blocks 14 (see FIGS. 4, 5, 6 and 11) as will become clearer when the invention is describe in operation. Hence, ring members 44 of the top and bottom rollers 28 and are co-linear.

The top roller 28 is moveable so as to selectively apply pressure to the blocks 14. The crunching device includes airpumps 41 mounted to the support unit 26 and to a moveable bar 43. The moveable bar 43 is mounted to the support unit 26 via tension springs (not shown) to bias it away from the bottom roller 30. The bar member 43 is mounted via a bracket (not shown), as will be understood by the skilled artisan to the top roller 28 and motor 38. When the airpumps 41 are filled with air via a compressor for example they expand pushing the bar member 43 downwards towards the bottom roller 30, which in turn moves the top roller 28 towards the bottom roller 30 exerting greater pressure to the blocks 14 therebetween.

Of course, the skilled artisan can contemplate a variety of actuators and airpumps to move the top and bottom roller towards each other so as to exert pressure on the blocks therebetween.

Figure 5:
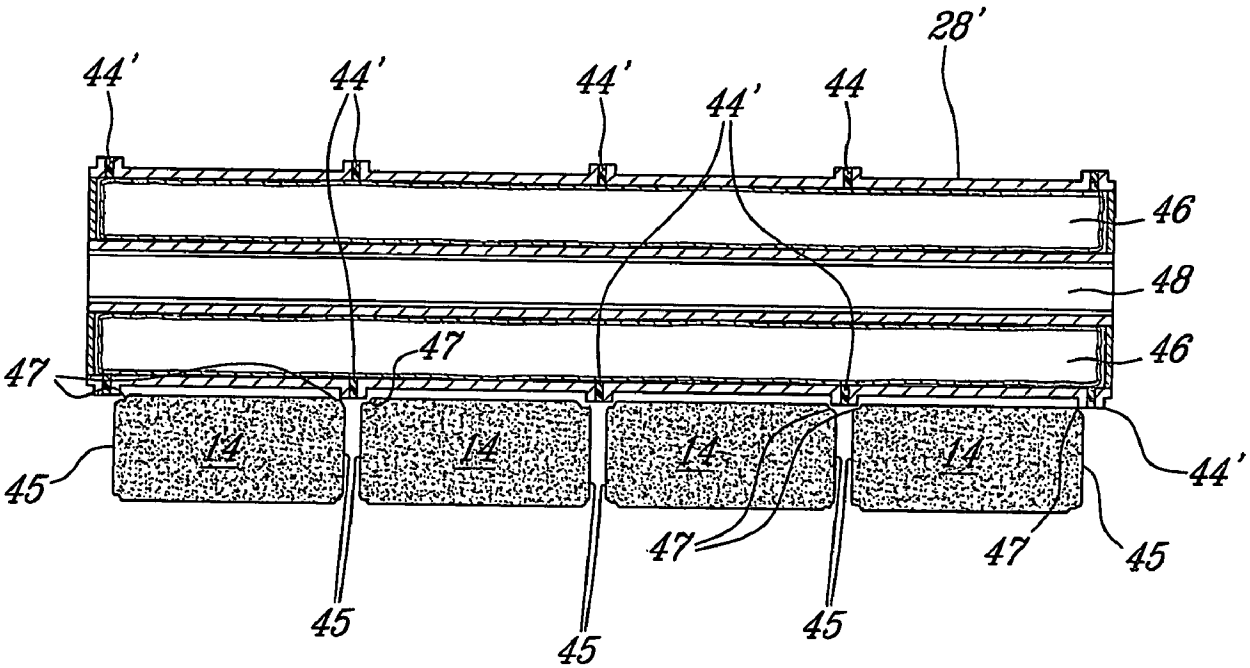
FIG. 5 is a front sectional view of a top roller of a block crunching device acting on blocks in accordance with an embodiment of the present invention.

In another embodiment shown in FIG. 5, the ring members 44 are expandable. FIG. 5 shows roller 28' including ring-members 44'. Roller 28' includes an airpump 46 to selectively expand the ring-members 44'. The airpump 46 surrounds a central aperture 48 that provides for the rotary actuators 32 and 34 to be mounted therethrough.

Returning to FIGS. 1 and 2, the translational movement assembly 18 comprises a block-displacement device 25 for translationally moving the blocks 14 along the support 12 and through the crunching-device 24 as will be described herein. In another embodiment, the translational movement assembly 18 comprises a plurality of block-displacement devices 25.

This block-displacement device 25 comprises a push member 50 including a proximal end 52, which is pivotally mounted to a push-member actuator assembly 54 via a pivotable support member 56. The push member 50 includes a distal end 58 having a block-engaging member 60.

The push-member actuator assembly 54 is slidably mounted to opposite guide members defined by the opposite lateral sides 62 and 63 of the support 12 so as to translationally move thereon in the direction shown by arrow A. The push-member actuator assembly 54 also serves to pivotally move the push-member 50 about a pivot axis X defined by the longitudinal support member 56 as shown by arrow B between substantially horizontal and substantially vertical positions. With particular reference to FIG. 2, each side 62 and 63 includes a top guide toothed rack 64 and a bottom guide track 65. The push-member assembly includes two motors 66 and 67 at each side 62 and 63 as shown in FIG. 1. Motors 66 and 67 include respective gearboxes 68. Turning back to FIG. 2, gearboxes 68 include a pinion gear 69 powered by a motor 66 or 67 so as to turn in a clockwise direction along the guide rack 64 driving the assembly 54 and push-member 50 forward as shown by arrow A. When the pinion 60 is turned in a counter-clockwise direction the assembly 54 and the push-member 50 are driven backward in a direction opposite to that shown by arrow A. The push-member actuator assembly 54 also includes free rollers 70, which roll along the guide track 65 when the assembly 54 along with the guide sides 62 and 63 as explained above.

Returning to FIG. 1, the push-member actuator assembly 54 also includes pivot actuators 71 powered a hydraulic motor (not shown) as will be understood by the skilled artisan and mounted the pivotable support shaft 56. In this way, the actuators 71 rotate the shaft 56 about its axis X when powered lifting or descending the push-member 50 as shown by arrow B in FIG. 2.

Figure 6:
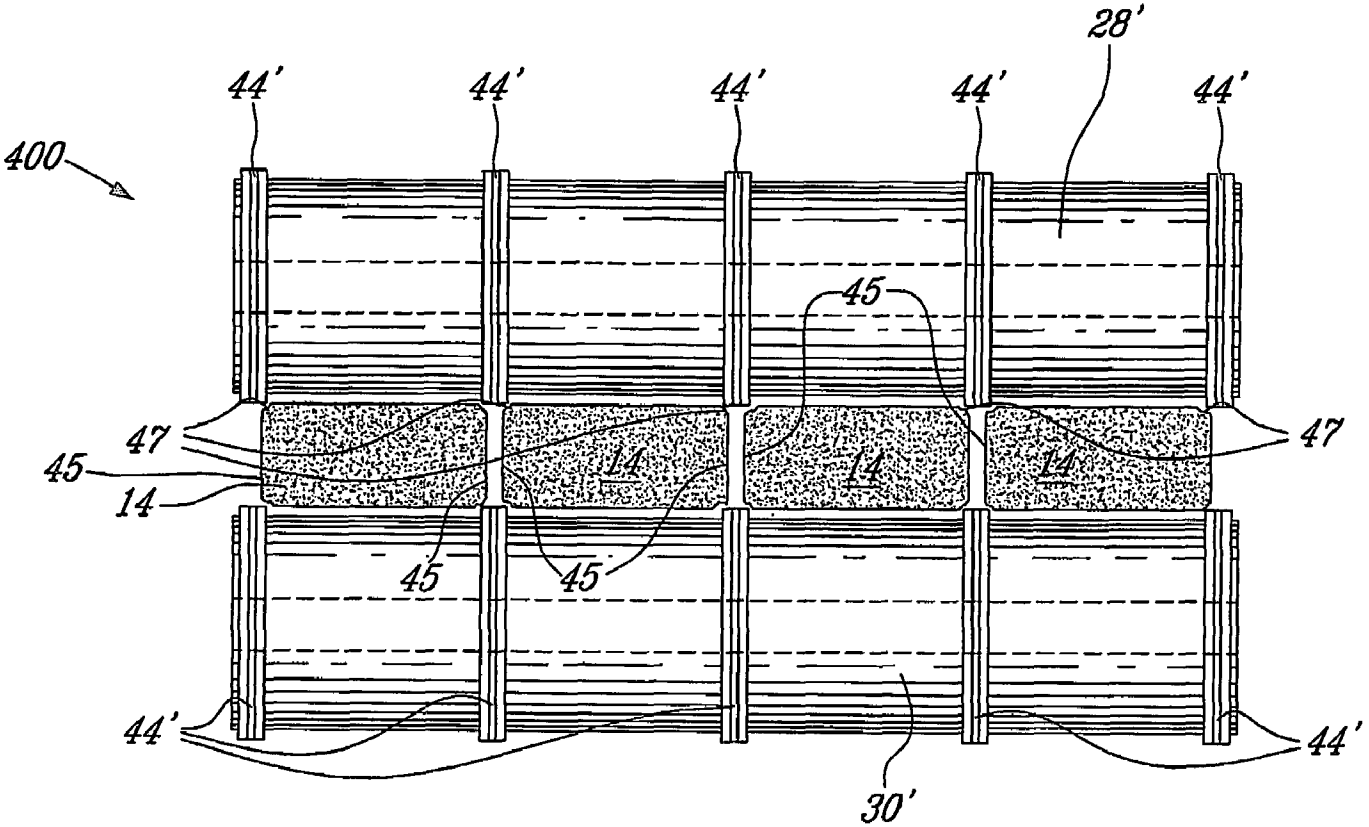
FIG. 6 is front elevational view of top and bottom rollers of a block crunching device in accordance with an embodiment of the invention acting on blocks similar to that of FIG. 4.
Figure 16:
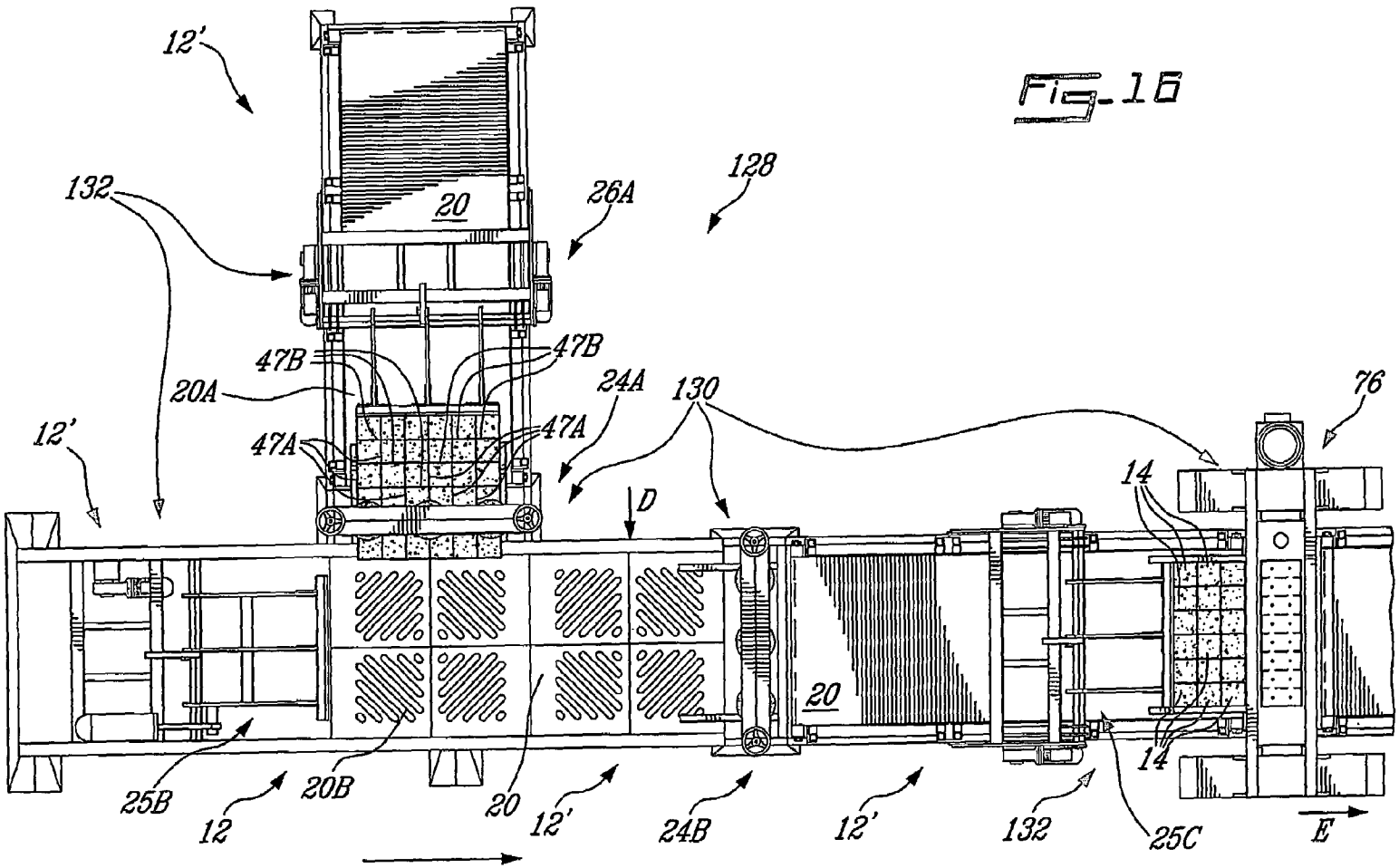
FIG. 16 is a top plan view of a block modifying apparatus in accordance with an embodiment of the present invention.

In operation, the blocks 14 are positioned on the block-displacement surface 20 of support 12. The push member 50 is in the horizontal position and the push-member actuator 54 moves the push-member 50 in the direction shown by arrow A, hence, the block-engaging member 60 engages and translationally moves the blocks 14 toward and through the crunching-device 24. As shown in FIG. 1, the support 12 includes opposite block guides 51 and 53 for guiding a group of blocks 14, as shown in FIG. 16, towards the crunching device 24. The blocks 14 are pushed between the top and bottom rollers 28 and 30, which rotate in the direction shown by arrow A. As the blocks 14 are pushed between rollers 28 and 30, the co-linear ring-members 44 engage the top and bottom edges 47 of a two opposite lateral sides 45 as shown in FIGS. 4 and 6. Simultaneously, during rotation of rollers 28 and 30, the top roller 28 is moved towards the roller 30 via expanding airpumps 41 and hence, the ring-members 44 apply pressure on the respective block edge 47 they engage, crunching, chipping, cracking, breaking and wearing down this edge 47 as it streams between the rollers 28 and 30.

It should be noted that a crunching-device 24 having rollers with ring-members not including air pumps or any other actuator for either expanding the ring-members or moving a top or bottom roller are also used in the context of the present invention.

The rollers 28 and 30 as well as the ring-members 44 of the invention may be provided in a variety of suitable sizes and configuration as will be understood by the skilled artisan.

Figure 7:
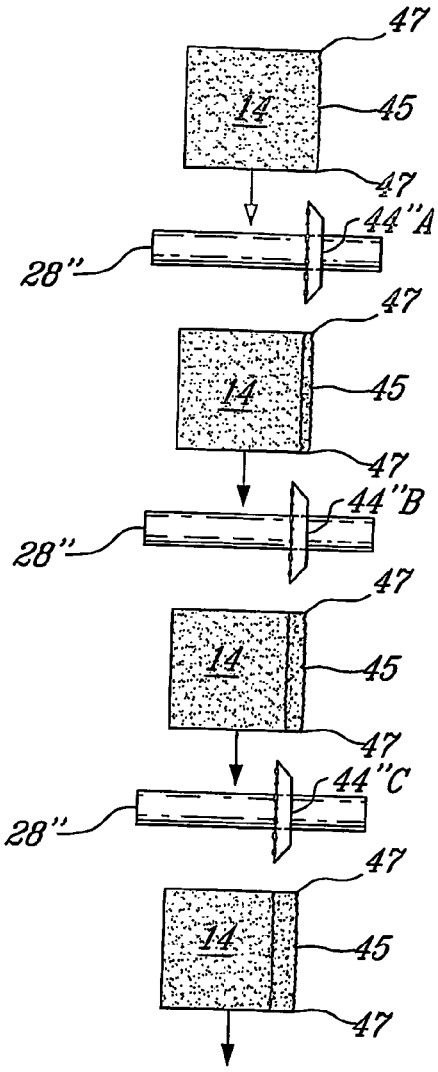
FIG. 7 is a schematic representation of block being streamed through a block-crunching device in accordance with an embodiment of the invention.
Figure 9:
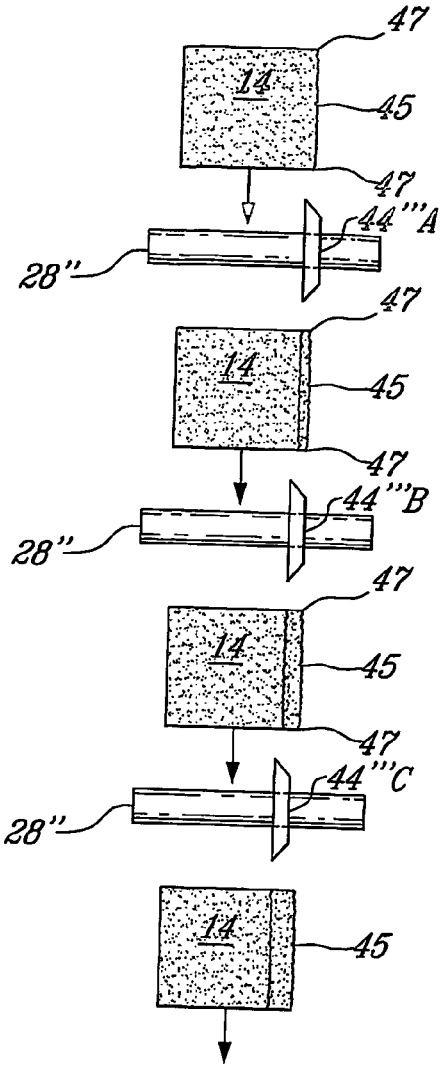
FIG. 9 is a schematic representation of block being streamed through a block crunching device in accordance with an embodiment of the invention similar to FIG. 7.

Further examples of rollers 28' and 30' and ring-members 44' are shown in FIGS. 5. 6 and 11, examples of rollers 28" and ring-members 44" and 44'" are shown in FIGS. 7 and 9.

In another embodiment shown in FIG. 5, the crunching device only provides a top roller 28' and hence, only top edges 47 of the blocks 14 are engaged and acted on.

In an embodiment schematically represented in FIGS. 7, a plurality of rollers, such as three rollers 28" having toothed ring-members 44" are adjacently positioned relative to one another. Only a top roller 28" is shown here, but a bottom roller, which is the mirror image of the top roller 28" in each case illustrated in FIG. 7 and 9, is also provided similarly to rollers 28 and 30 of block crunching device 24.

Figure 8:
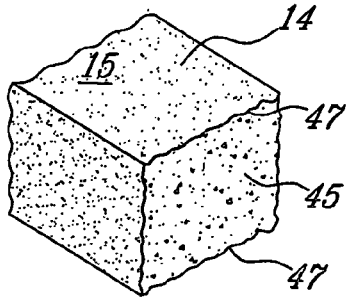
FIG. 8 is partial perspective view of a block before it is streamed through the block crunching devices schematically represent in FIGS. 7 and 9.
Figure 10:
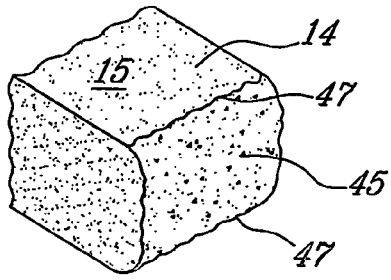
FIG. 10 is partial perspective view of the block of FIG. 8 after it is streamed through the block crunching devices schematically represent in FIGS. 7 and 9.

In an embodiment schematically represented in FIGS. 7, a plurality of pair of top and bottom rollers, such as the three adjacent pairs of top and bottom rollers 28"A, 28"B and 28"C (only the top rollers 28"A, 28"B and 28"C are represented here, yet each bottom roller is mirror image of its top roller) include respective toothed ring-member 44"A, 44"B and 44"C. Ring-member 44"B is inwardly shifted with respect to ring-member 44"A; similarly ring-member 44"C is inwardly shifted with respect to ring-member 44"B. The foregoing is true for the mirror-image bottom rollers, which are not illustrated. Hence, the respective ring-members of a plurality of pairs of top and bottom rollers are progressively shifted inwardly from the most upstream roller to the most downstream roller. In this way, such a block-crunching device 24 acts on a block 14, as shown in FIG. 8, to give it a convex curved side 45 that recedes towards it edges 47, as shown in FIG. 10. In fact, FIG. 8 shows a block 14 before having been passed through these three sets of pairs of top and bottom rollers having progressively inwardly shifted ring-members and FIG. 10 represents how this block 14 looks after it was acted on by the three foregoing pairs of rollers.

FIG. 9 is a schematic representation similar to FIG. 7 with the difference being that the ring-members 44'"A, 44'"B and 44'"C are not toothed. The result of passing a block 14, such as shown in FIG. 8, through three pairs of rollers 28' (the mirror-image bottom roller is not shown in FIG. 9) produces a block 14 having the configuration shown in FIG. 10.

Hence, each of the block-modifying assemblies of FIGS. 7 and 9 provide three adjacent block-crunching devices.

Figure 11:
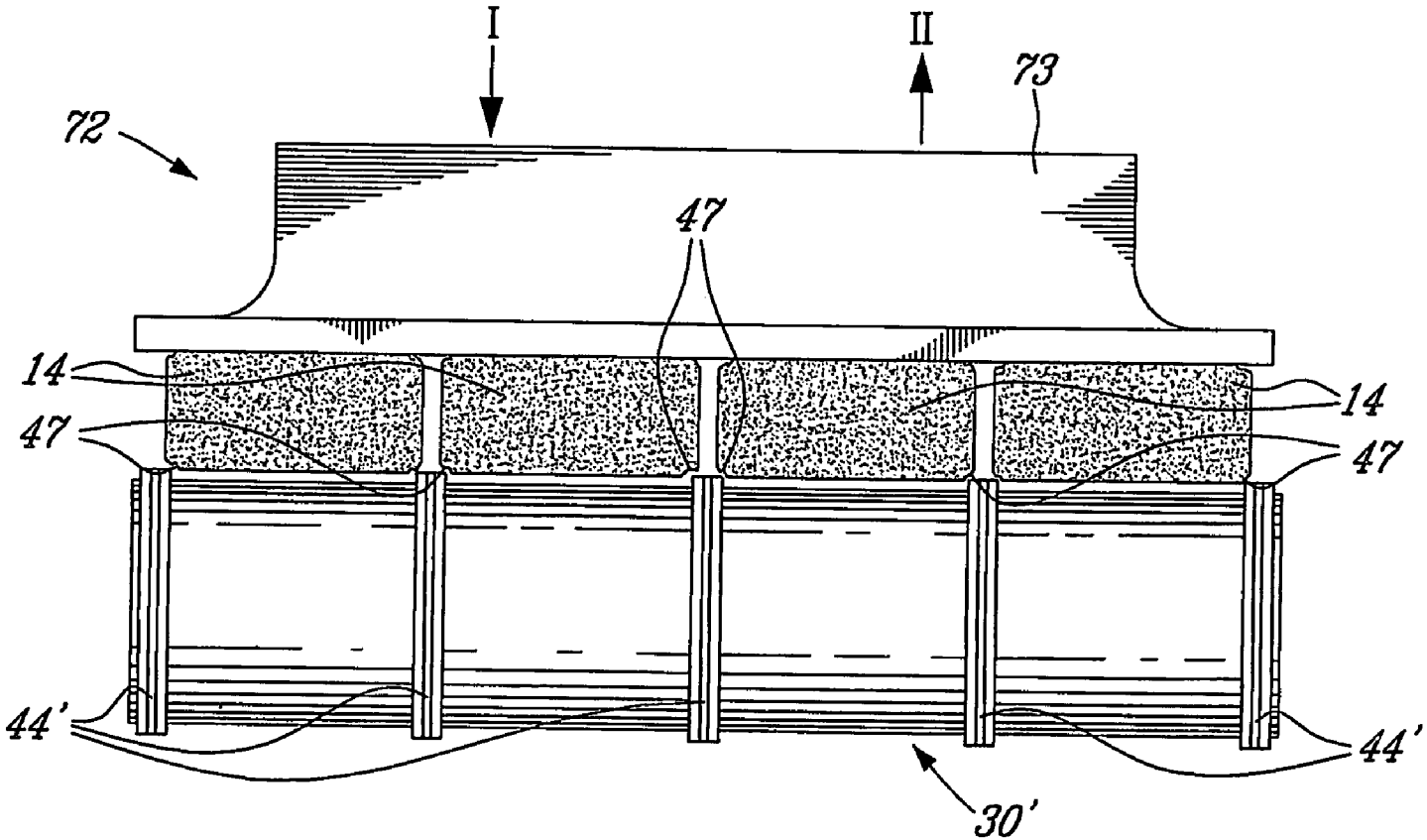
FIG. 11 is a front elevational view of a block crunching and abrading device in accordance with an embodiment of the invention.

In another embodiment, shown in FIG. 11, the block-texture-modifying assembly 16 comprises a crunching-device 72. Device 72 comprises a bottom roller 30' including expandable ring-members 44' and a top-support member 73. The top-support member 73 is so positioned and configured as to permit the expanding ring-members 44 to add the necessary pressure on bottom edges 47 of blocks against the top-support member 73.

In a further embodiment, the top-support member 73 is moveable as shown by arrows I and II and acts as an abrader to scratch and wear down the top surface of the blocks 14 it abuts.

It should be noted that the expandable ring-members of a given roller need not all be simultaneously expanded and they need not be expanded at regular intervals. Hence, respective and independent air pumps rather than a common air pump 46 may expand each ring-member separately. This causes the random wearing down, cracking and chipping of edges 47 during the translational movement between the blocks 14 and the block-texture-modifying assembly 16 as described herein.

Furthermore, a plurality of smaller rollers may be used rather than a longer common roller such as 28 and 30. Some of these smaller rollers may also be moveable.

FIGS. 12, 13, 14 and 15 show a block texture modifying apparatus 74 in accordance with another embodiment of the invention.

The apparatus 74 also comprises a support 12 and a translational movement assembly 18 similar to the ones described for the apparatus 10 and hence, need not be further described herein for concision purposes only.

The apparatus 74 comprises a block-texture-modifying assembly 76 in accordance with another embodiment of the present invention.

This assembly 76 comprises a block-texture-modifying device 78, which in this example is an abrading device. In another embodiment, the block-texture-modifying assembly 76 may comprise a plurality of abrading devices.

Figure 12:
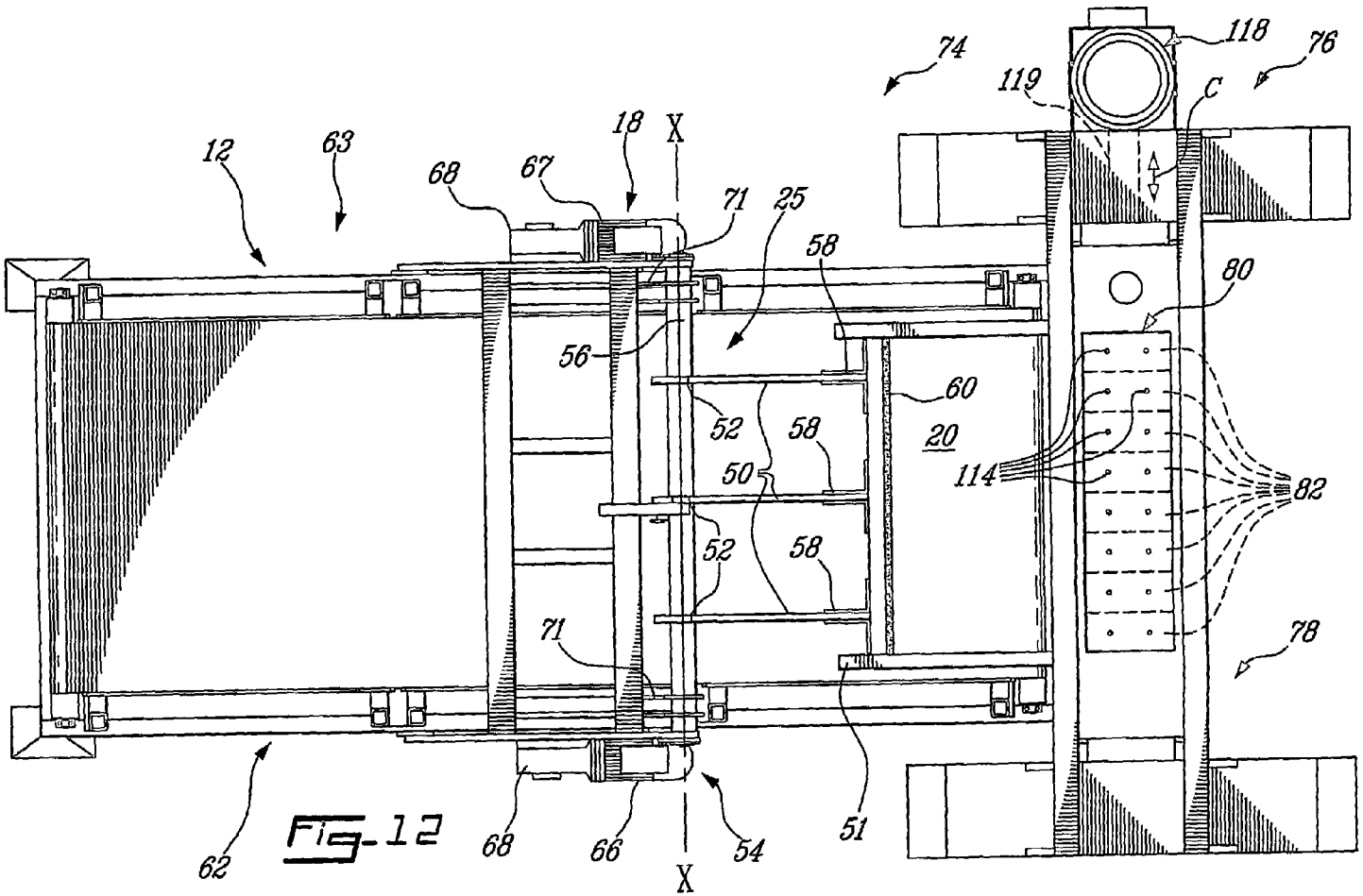
FIG. 12 is a top plan view of a block texture modifying apparatus in accordance with an embodiment of the present invention.
Figure 13:
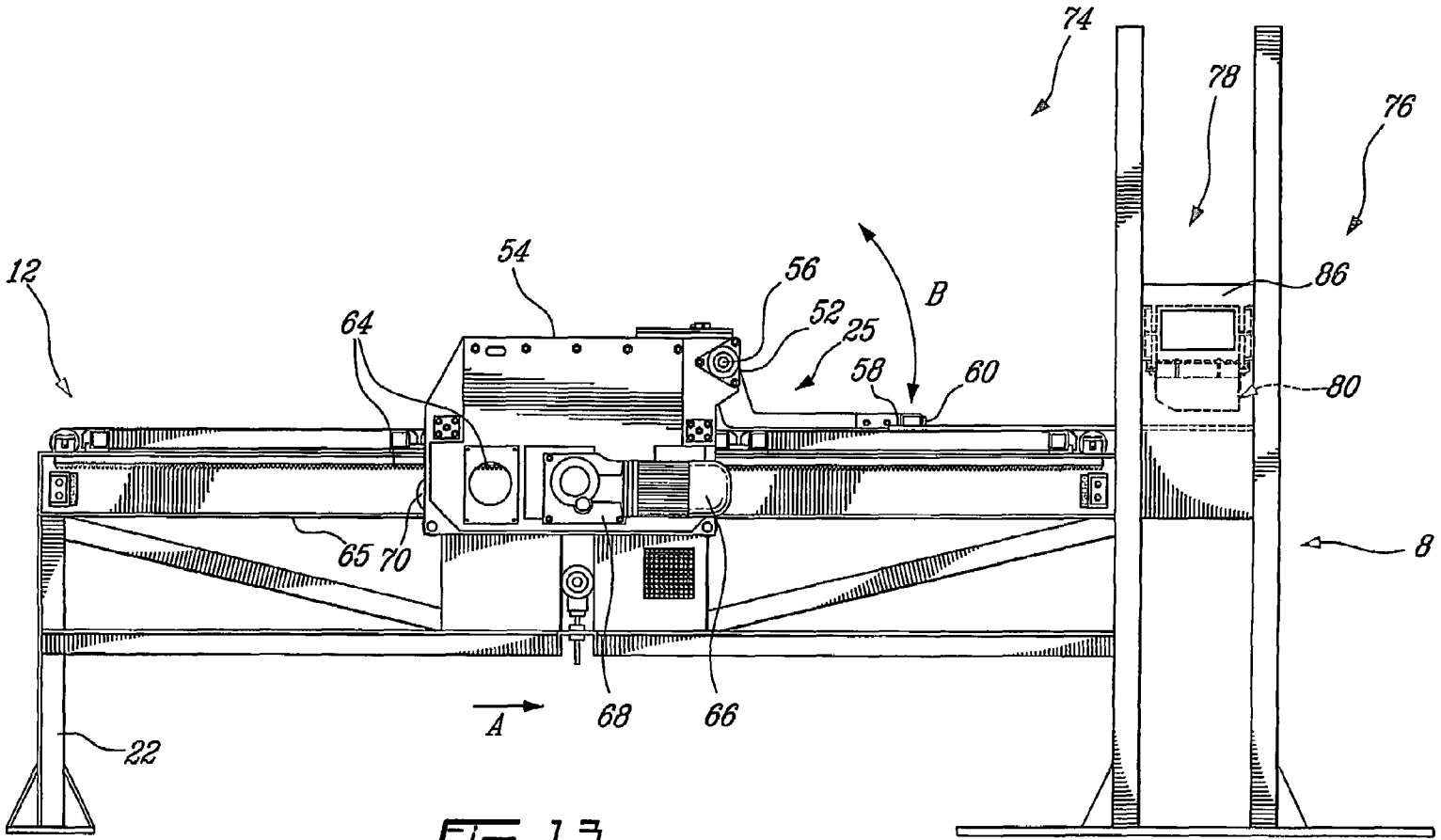
FIG. 13 is a side, lateral and elevational view of the apparatus of FIG. 12.

As shown in FIGS. 12 to 15, the abrading device 78 includes an abrader 80 in the form of a series of side-by-side slabs 82 having an abrading bottom surface 84 for engaging the top surfaces 15 of blocks 14 (see FIGS. 8, 10 and 14) during the translational movement as will be explained herein. The abrader 80 is secured to a moveable tubular and substantially rectangular carrier 86, which is moveably mounted to the support unit 85 which is mounted to the support 12 as shown in FIG. 13.

Figure 14:
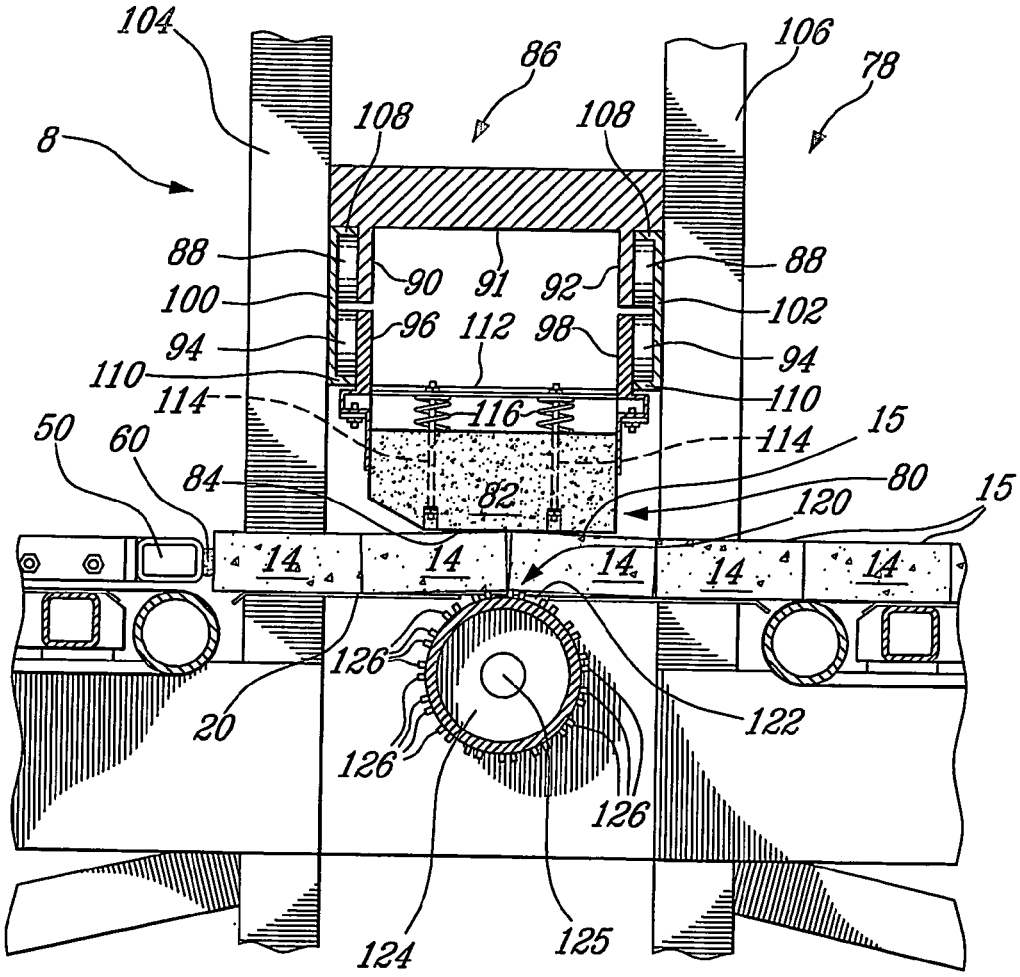
FIG. 14 is side elevational view of the abrading device of the apparatus of FIG. 12 modifying the surface texture of blocks.

With particular reference to FIG. 14, the carrier 86 includes top free rollers 88 mounted to its opposite lateral top walls 90 and 92, respectively, downwardly extending from a ceiling 91, and bottom free rollers 94 mounted to its bottom opposite lateral walls 96 and 98 respectively. Opposite guide members 100, 102 are fixedly mounted to opposite columns 104 and 106 of the support unit 84. Guide members 100 and 102 define respective top and bottom guide tracks 108 and 110 respectively. Top rollers 86 rollingly engage top tracks 108 and bottom rollers rollingly engage bottom tracks 110.

Each slab 82 is fixedly secured to a panel 112 via rods 114 embedded within the slabs 82 and fastened to the panel 112 (also see FIG. 12). Panel 112 is secured to the opposite bottom lateral walls 96, 98. Each slab 82 is biased towards the support 12 via a spring 116 sandwiched between the panel 116 and the slab 82 and mounted to the rod 114.

Figure 15:
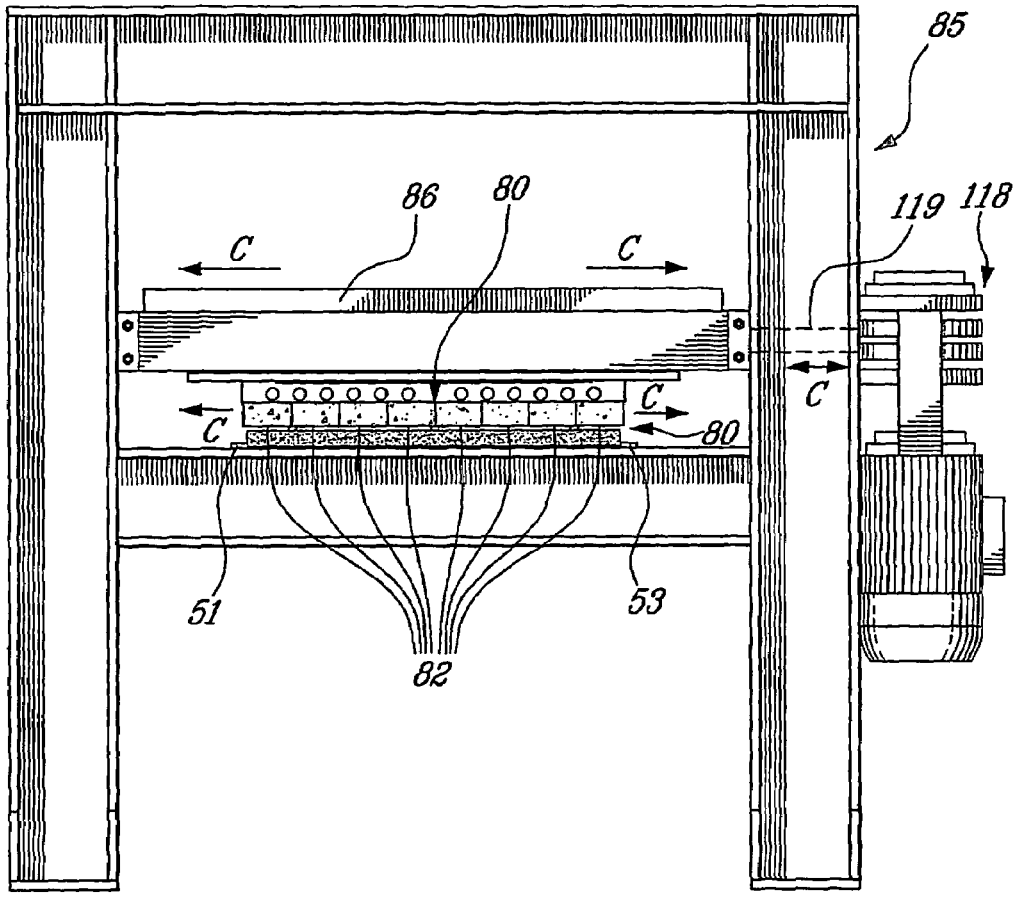
FIG. 15 is a front elevational view of the apparatus of FIG. 12.

As shown in FIGS. 12 and 15, carrier 82 is actuated by a motor 118 via a crankshaft 119 mounted thereto, as is known in the art, to be reciprocally moved in a side-to-side direction as shown by arrows C. In this way, top rollers 86 roll along top guide tracks 108 and the bottom rollers 88 roll along bottom guide tracks 110. Hence, moving the abrader 80 in a side-to-side fashion as shown by arrows C, when the abrading surface 84 engages and acts on the blocks 14 during their translational displacement thereunder.

With reference to FIG. 15, the abrading device 78 also comprises a block-lifting assembly 120.

The block-lifting assembly comprises an opening 122 in the displacement surface 20 of the support 12, a roller 124 is positioned beneath the displacement surface 20 at opening 122. The roller is mounted to a rotary actuator 125 powered by a motor (not shown) so as rotate in a clockwise direction which is the direction of the displaced blocks 14 during the translational movement, as shown by arrow A in FIG. 13. The roller 124 includes protrusions 126 extending therefrom and protruding from the opening 122 to engage and lift the displaced blocks 14 against the abrading surface 84.

In operation, the push member 50 translationally moves the push-member 50 along the displacement surface 20 in the direction shown by arrow A. As the blocks 14 are moved under the abrading surface 84, they are engaged thereby. Simultaneously, the abrader 80 is moved in a side-to-side fashion as shown by arrow C and as previously explained acting on the top surface 15 of the blocks 14 so as to abrade, wear or polish the top surface 15. Simultaneously, the roller 122 rolls clockwise in the direction of the displaced blocks 14. In this way protrusions 126 protrude through the opening 122 to engage and lift the blocks 14 against the slabs 82 they are engaged by as well as against the biasing pressure of spring 116. In this way, the blocks 14 are abraded or worn or polished by the abrader in a non-uniform or random way, given them the desired look.

The skilled artisan will appreciate that a number of ways and mechanisms of moving the abrader 80 can be contemplated within the scope of the invention. Furthermore, the abrader 80 is moveable in a back and forth fashion or a circular fashion using appropriate actuators and motors as is known in the art.

In another embodiment, the abrading device 78 need not include a block lifting surface 120.

FIG. 16 shows a further embodiment of a block texture modifying apparatus 128.

Apparatus 128 comprises a block support 12', a block texture modifying assembly 130, and a transitional movement assembly 132.

The block support 12' defines a continuous block displacement surface 20.

The block texture modifying assembly 130 comprises first and second block crunching devices 24A and 24B and an abrading device 78 respectively.

The transitional movement assembly 132 includes three block displacement devices 25A, 25B, and 25C similarly constructed to the block displacement device 25 described hereinabove.

In operation, the blocks 14 are placed on the support 12' at an area 20A of the displacement surface 20. The blocks 14 are pushed by the block displacement device 25A in the direction shown by arrow D towards and through the crunching device 24A, which acts on opposite lateral edges 47A of the blocks 14. In this way, the block displacement device 25A pushes the blocks 14 onto area 20B of the block displacement surface 20. Then the block displacement device 25B pushes the blocks 14 in the direction shown by arrow F towards and through the block crunching device 24B, which now acts on the other opposite edges 47B. The block displacement device 25B continues to push blocks 14 towards area 20B of the block displacement surface 20. Then the block displacement device 25C will push the blocks 14 in the direction shown by arrow E towards and through the abrading device 78 that acts thereon as explained above.

Of course, the skilled artisan can contemplate adding a greater number of various texture modifying devices described herein along a longer block displacement surface 20. For example, the blocks 14 may be pushed through another abrading device 78, which is positioned in a direction that is generally orthogonal to the positioning of the abrading device 78 shown in FIG. 16. In this way, the abrading device 78 will abrade the top surface 15 of the blocks 14 in a side-to-side fashion that is generally orthogonal to the first side-to-side abrading movement.

It should be noted that in all the above embodiments any surface of a given block 14 could be modified.

Figure 17:
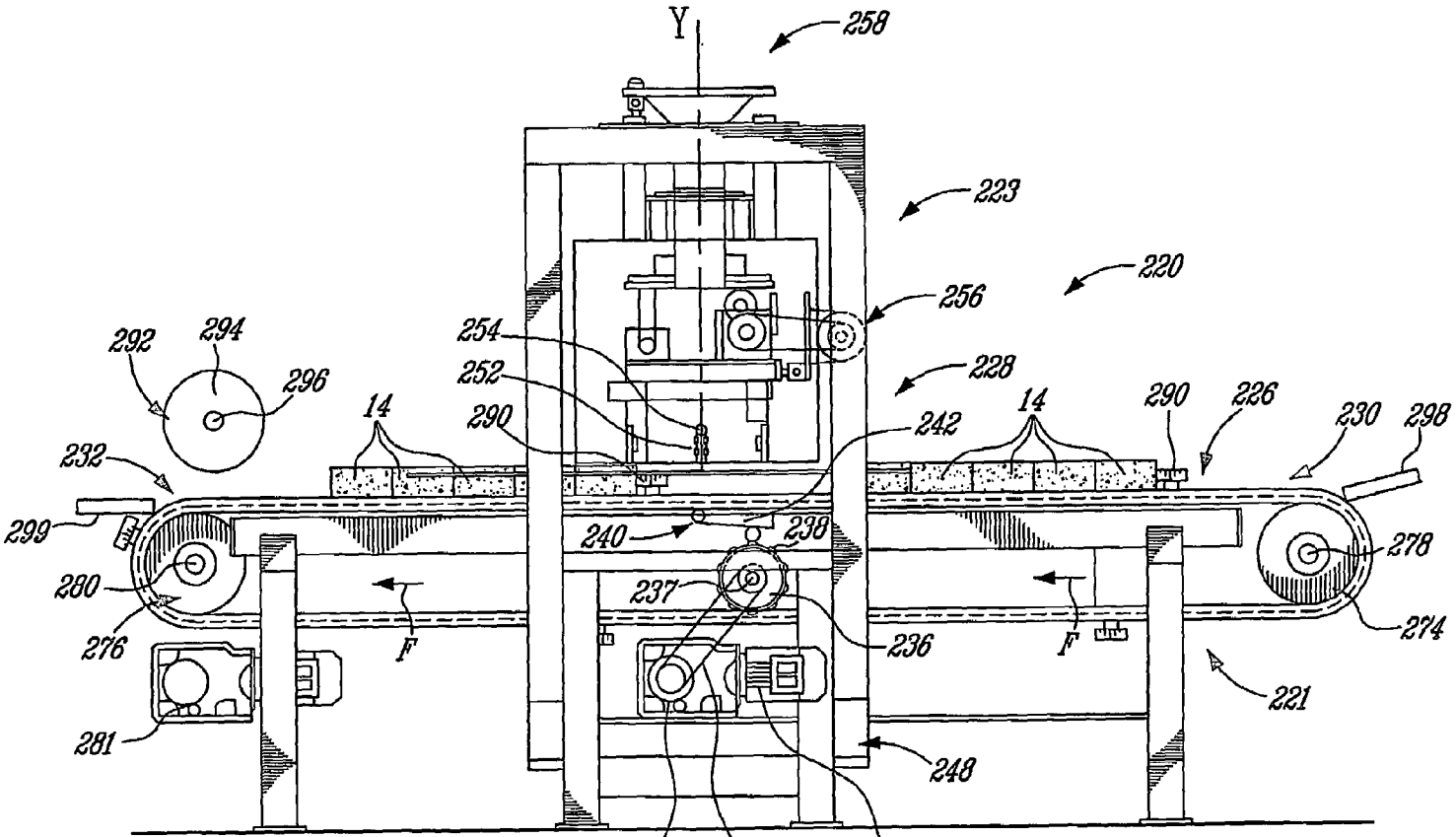
FIG. 17 shows a side view of a block-texture-modifying apparatus according to an embodiment of the present invention.
Figure 18:
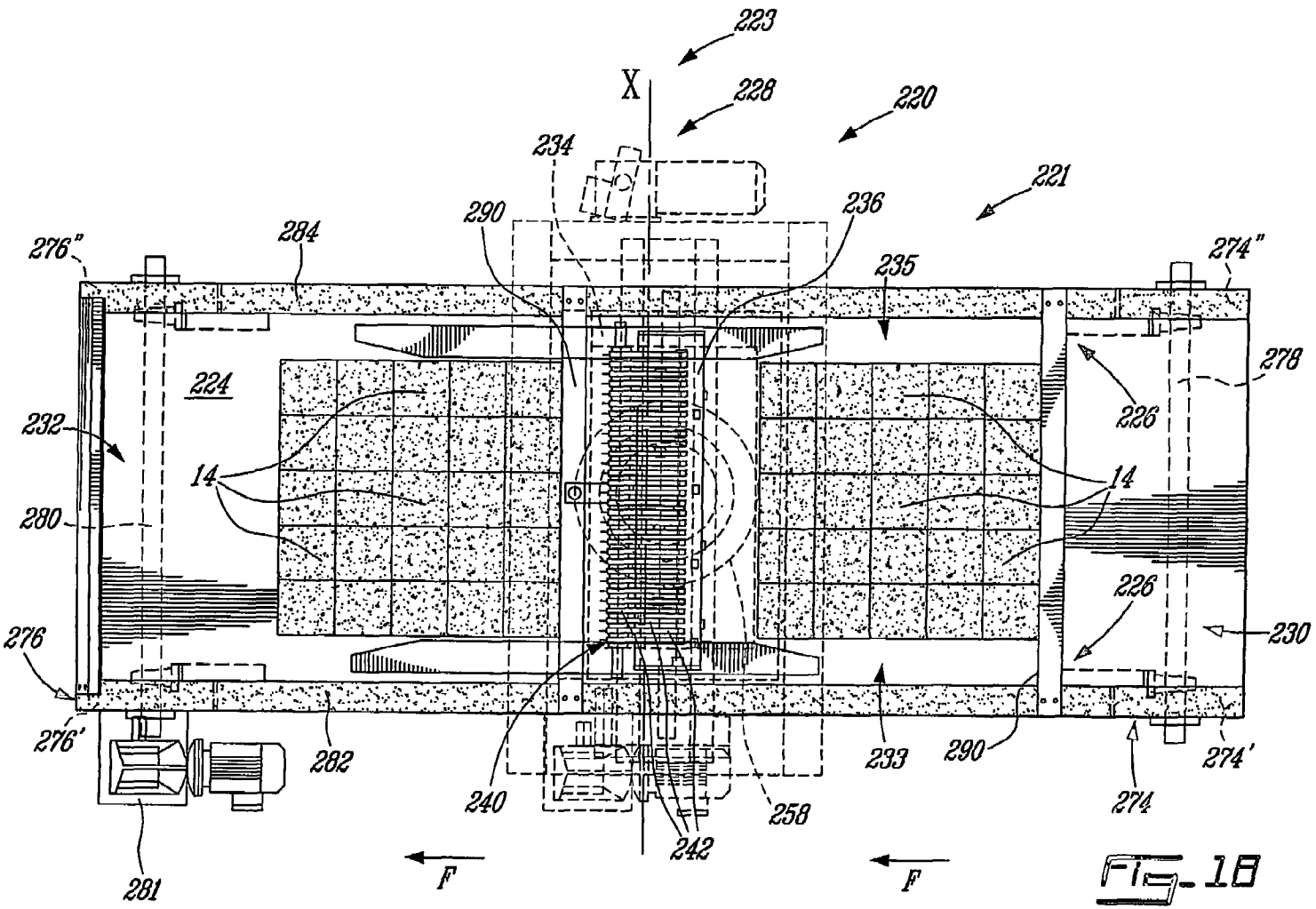
FIG. 18 is a top plan view of the apparatus of FIG. 17.

FIGS. 17 and 18 show a block texture modifying apparatus 220 for modifying the surface texture of blocks 14.

The block-texture-modifying apparatus 220 comprises a support 221 having a block displacement surface 224 (see FIG. 18), a block-texture-modifying assembly 223 and a transitional movement assembly 226.

The block displacement surface 224 includes in-feed and out-feed ends 230 and 232 respectively, and first and second lateral side 233 and 235 respectively (see FIG. 18), as well as an opening 234 (see FIG. 18).

The block-texture-modifying assembly 223 is a block-chipping assembly and comprises a block chipping device 228 and a block-lifting surface in the form of a block-lifting assembly 225. In this respect, the opening 234 provides for including and exposing the block-lifting assembly 225 as will be further discussed below. In another embodiment, the block-texture-modifying assembly may comprise a plurality of devices 228.

Figure 19:
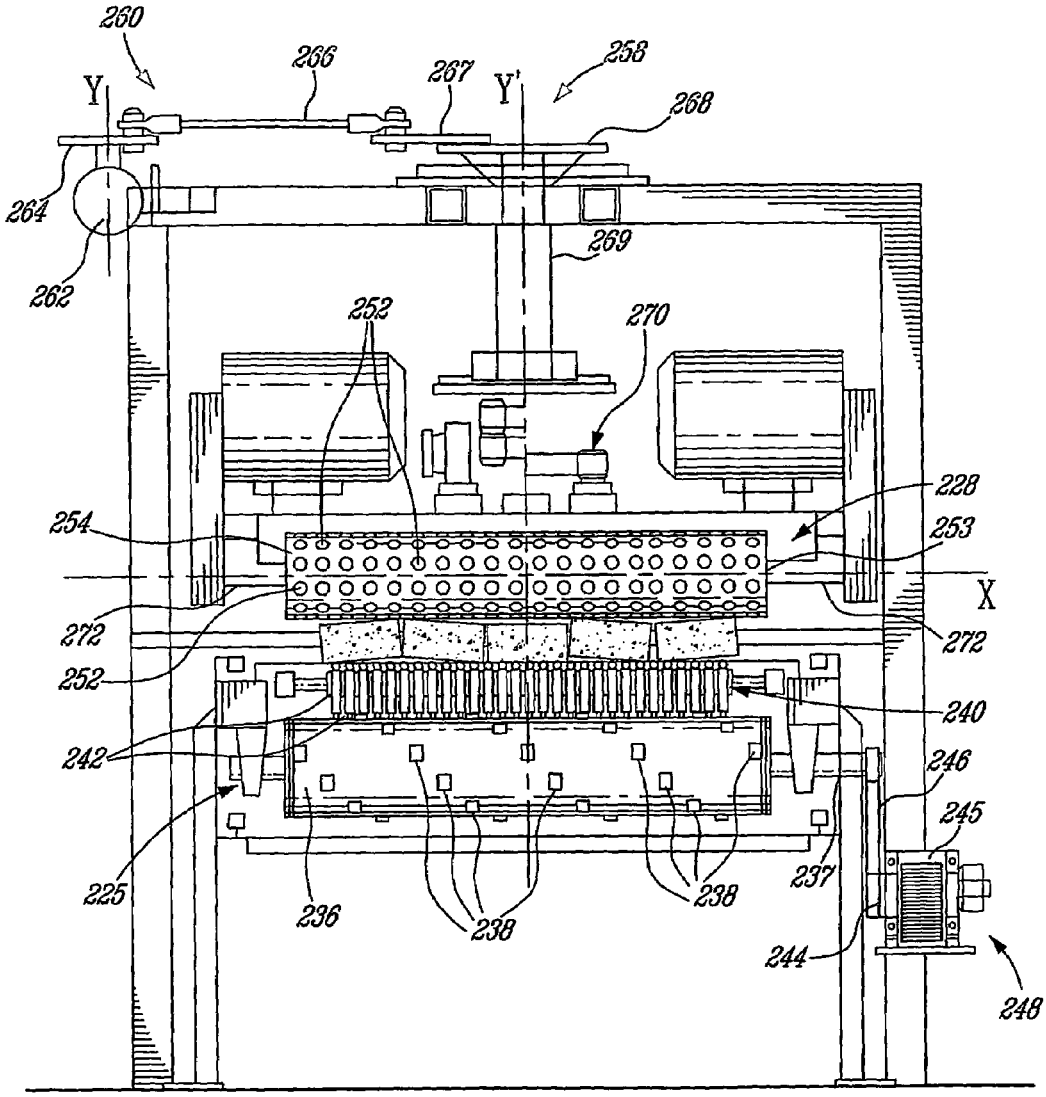
FIG. 19 is a front view of the apparatus of FIG. 17.
Figure 20:
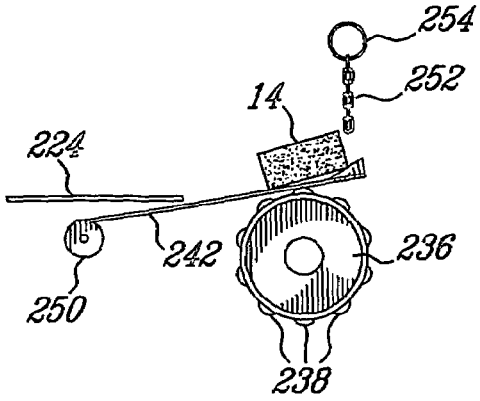
FIG. 20 is a schematic view of the block-chipping assembly of FIG. 17.

As shown in FIGS. 17, 18 and 19, the block-lifting assembly 225 includes a roller 236 with protrusions such as cam members 238 randomly disposed thereon. A block-lifting surface 240 is positioned above roller 236. The block-lifting surface 240 comprises side by side liftable finger-members 242. With particular reference to FIGS. 17 and 19, the roller 236 comprises a rotary shaft 237 mounted to a roller actuator 244, which is powered by a motor 245, via a belt 246 so as to be rolled thereby. As will be discussed when the invention is described in operation, the cam members 238 provide for lifting the finger-members 242 and consequently lifting any blocks 14 thereon. In this way, the roller 236 and its actuator 244 act as a liftable finger-member actuator 248. As shown in FIG. 20, each liftable finger-member 242 is hinged to a support member 250.

With particular reference to FIGS. 17 and 19, the block-chipping device 228 is spaced above the displacement surface 124 and includes block-chipping elements 252 mounted about a chipping member 254. In the example illustrated here, the block chipping elements 252 are protrusions. In one embodiment shown in FIG. 19, protrusions 252 are protuberances; while in another embodiment illustrated in FIG. 20, protrusions 252 are chain members. It should be noted that chains used for chipping may include a weight (not shown) on their chipping end such as a protuberance or any other impacting element. The chipping member 254 is in the form of a longitudinal rotating-member such as a roller. As schematically shown in FIG. 17 and as can be understood by the skilled artisan, an actuator 256 powers the chipping rotating-member 254 so as to roll it about its longitudinal axis X' defined thereby (also see FIG. 19).

With general reference to FIGS. 17, 18 and 19, the block chipping device 228 includes a rotation assembly 258 that is mounted to the chipping rotating-member 154.

With particular reference to FIG. 19, the rotation assembly 258 is schematically illustrated and includes an actuator assembly 260 including a motor 262 configured to spin a crank 264 about a vertical axis Y. A rod 266 is pivotally mounted at one end thereof to the crank 264 and pivotally mounted at another end thereof to a crank 268 via an extension 267. Hence, during spinning the crank 264 consequently moves the rod 266 backwards and forwards causing the crank 268 to spin about a vertical axis Y'. The crank 268 is fixedly mounted to a vertical shaft 269, which is connected to a bracket member 272 via a crankshaft assembly 270 as will be understood by the skilled artisan. The bracket member 272 is mounted about the longitudinal ends 251 and 253 of longitudinal rotating member 254. In this way, the longitudinal member 254 is rotated about a second axis of rotation Y' which is generally orthogonal to its first axis of rotation X'.

Turning back to FIGS. 17 and 18, the translational movement assembly comprises a block displacement device 226 including opposite rollers 274 and 276 each powered by a respective rotary actuator 278 and 280. With particular reference to FIG. 18, The rollers 274 and 276 comprise respective pairs of wheels 274', 274" and 276', 276". Wheels 274' and 276' are at one lateral side 233 of the support 221, whereas wheels 274" and 276" are at the opposite lateral side 235. A motor 281 powers actuator 280 to rotate in the direction shown by arrow F and actuator 278 is idle. Two opposite conveyor belts 282 and 284 near lateral sides 233 and 235 respectively are mounted to both rollers 274' and 276' and to 274" and 276" respectively. Longitudinal block engaging elements 290 are mounted at their respective longitudinal ends to each opposite side belts 282 and 284 to be conveyed thereby and to engage the blocks 14, as will be explained when the invention is described in operation.

In operation, rollers 274 and 276 displace the conveyor belts 282 and 284 in the direction shown by arrows F, hence, the block engaging elements 290 engage the blocks 14 and displace these blocks 14 in the direction shown by arrows F from the in-feed end 230 to the out-feed end 232. The blocks 14 are displaced along the displacement surface 224 towards the block lifting assembly 225. As blocks 14 are displaced on the finger-members 242, roller 236 rolls so that cams 238 engage the finger-members 242, lifting the finger-members 242 above the displacement surface 224 and consequently lifting a given block 14 that is displaced on that particular finger-member 242. Consequently, that given lifted block 14 engages a chipping element 252. Concurrently, the longitudinal chipping rotating-member 254 spins about its spinning axis X' causing the protrusions 252 to spin and strike the blocks 14, chipping any block 14 in engagement therewith. It should be noted that since the cams 238 are randomly disposed about the roller member 236, they lift random finger-members 242 causing blocks 14 to be randomly chipped on different areas by protrusions 252 chipping the block 14 in a random fashion and avoiding motifs when modifying the surface texture of a given block 14. Furthermore, the rotation assembly 258 provides for the longitudinal chipping rotating-member 254 to rotate about the axis Y' adding a further variable to the random chipping action of chipping elements 252, especially when the blocks 14 are disposed as shown in FIG. 18. It should be noted that when the liftable fingers 242 are not lifted, the blocks 14 are not engaged by the chipping elements 252, and hence, the chipping device 228 is so spaced above the displacement surface 224 and the block lifting assembly 225 as to allow for blocks 14 to be conveyed thereunder without the chipping elements 252 engaging the block 14 during actuation of the chipping device 228. In another embodiment, the blocks 14 are chipped when a finger-member 242 is not lifted and merely chipped to deeper degree when the finger-member 242 is lifted towards a chipping element 252.

FIG. 17 also shows that the apparatus 220 may include an abrading device 292, which includes a drum roller 294 and an actuator 296. The drum roller 294 may be made of concrete or another cementitious material. The blocks 14 are displaced under drum roller 294 which engages the blocks 14 and scrapes them in order to mark their surface in a fashion that is similar to the way blocks scrape each other in a conventional tumbler.

The apparatus 220 may also include in-feed and out-feed assemblies 298 and 299 at the in-feed and out-feed ends 230 and 232 respectively.

Keeping the above description in mind other alternative features without limitation thereto of the above embodiment will be described hereunder.

The block displacement surface 224 can be provided in a variety of configurations that are suitable for slidably displacing blocks 14 thereon. A variety of in-feed and out-feed assemblies such as 298 and 299 can also be provided, yet, it is to be understood that the present invention does not require the use of such in-feed or out-feed assemblies.

The block displacement device 226 may also be provided in a variety of configurations that are suitable for displacing blocks 14 on displacement surface 224. For example, the opposite rollers 274 and 276 may be drum rollers without wheel elements at their respective longitudinal ends. The conveying belts 286 and 828 may be a single carpet belt spanning the width of the drum rollers. This carpet belt may include an opening for exposing the block lifting assembly 25. As will be exemplified in a later embodiment described herein, the block displacement device 26 may also be a top conveyor spaced above the displacement surface 224 and including engaging elements extending therefrom in order to engage the blocks and slidingly push them along the block displacement surface 224. In this way, the block displacement device 226 may include rollers having a belt on the longitudinal ends of the rollers in a similar fashion, as described above. These belts would be spaced apart in order to allow room for the block chipping apparatus therebetween which is also spaced above the block displacement surface 224.

The block-lifting device 225 may include block-lifting finger-members 242 of various types and configurations such as boards or the like. Furthermore, the block lifting finger-members 42 may be placed throughout the displacement surface 224. In this way, an above position displacement assembly 226 will be convenient to this particular embodiment. Furthermore, in the foregoing embodiment, a plurality of rollers 236 may be placed under the displacement surface 224 for actuating the various block-lifting finger-members. It may also be contemplated within the scope of the present invention to use a moveable roller that can be displaced along the underlength of the block displacement surface 224 in order to lift various block lifting finger-members 42 positioned throughout the displacement surface 224. Furthermore, it may also be contemplated by the skilled artisan, within the scope of the present invention, not to use rollers 36 having cams 38 but to use other electronic means to lift the block lifting finger-members 42.

The block chipping device 228 may be provided in a variety of configurations using various types of chipping and spinning rollers 254 and chipping elements 252 such as chains, protrusions, and the like. Of course, a plurality of chipping elements 252 positioned above the displacement surface 224 may also be contemplated.

Of course, various types of actuating systems and motors for actuating various components of the present invention may be contemplated by the person having skill in the art within the scope of the present invention.

The rotation assembly 258 may also be provided in a variety of configurations within the scope of the invention.

Figure 21:
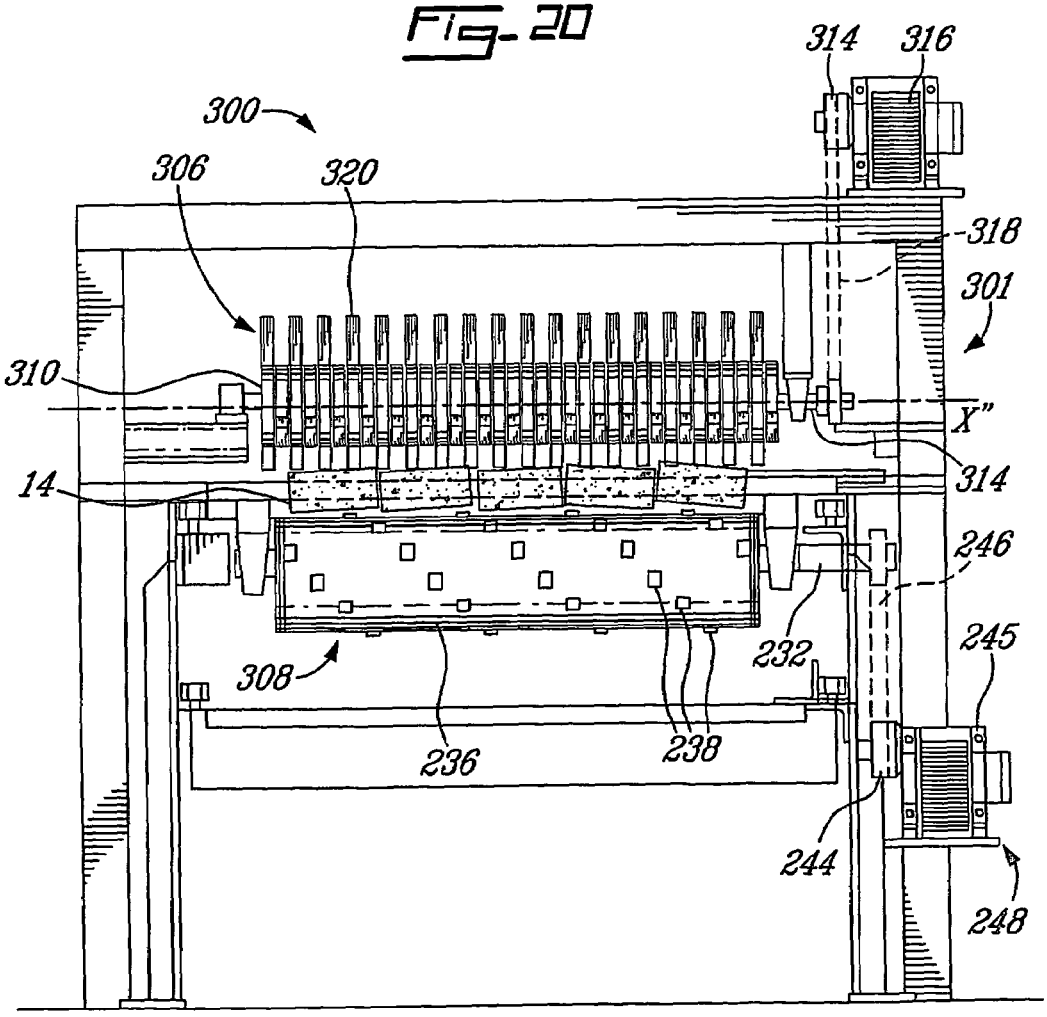
FIG. 21 is a front view of a block-texture-modifying apparatus in accordance with an embodiment of the invention.
Figure 22:
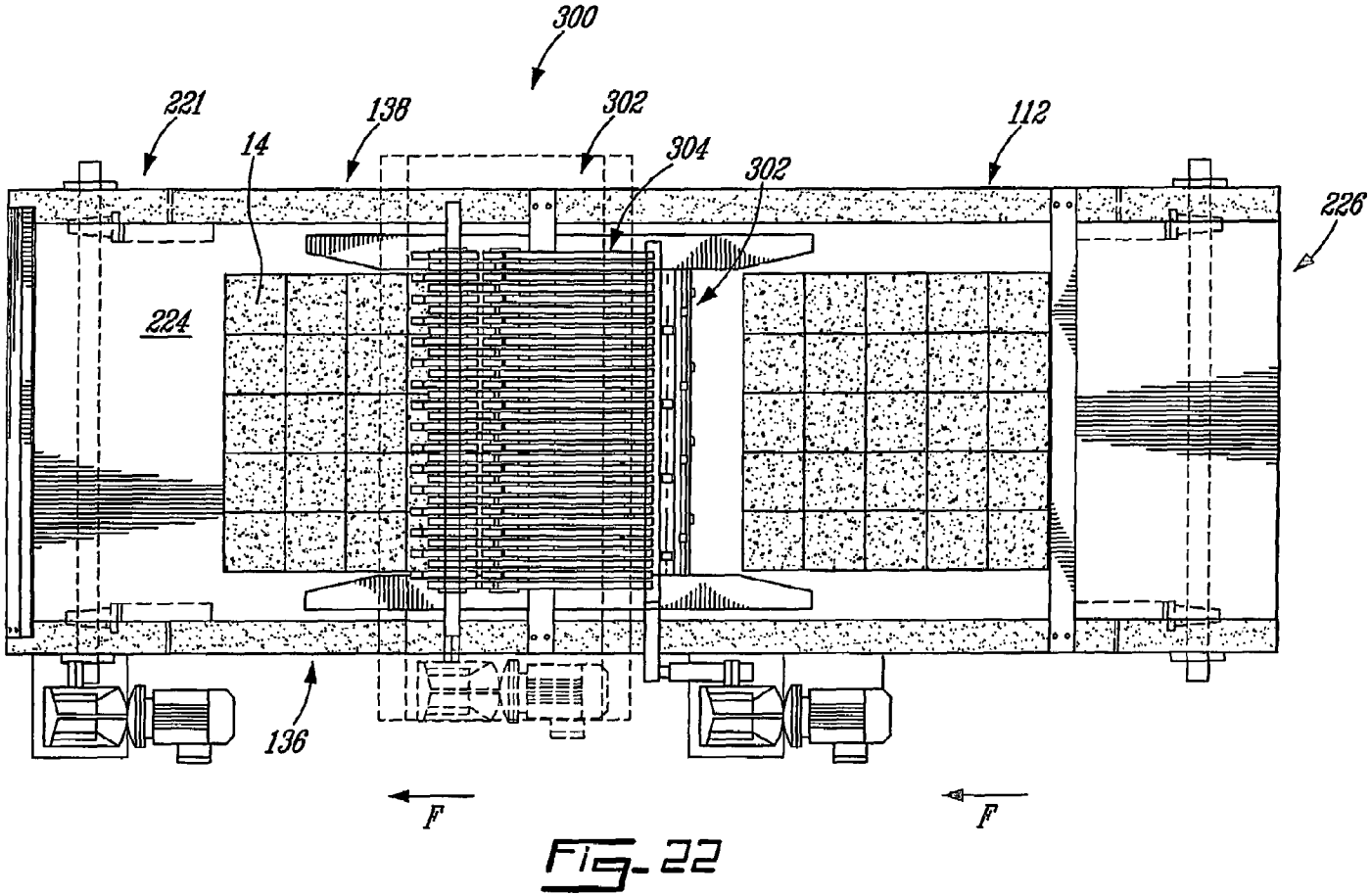
FIG. 22 is a top plan view of the apparatus of FIG. 21.
Figure 23:
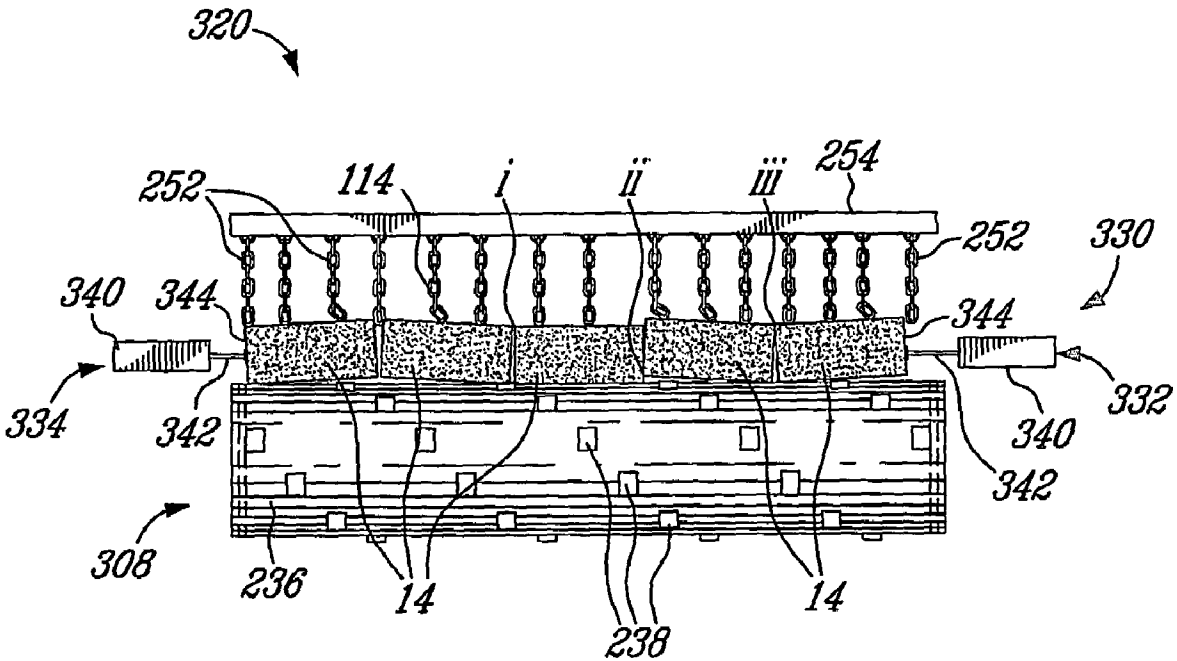
FIG. 23 is a front schematic view of a block-assembly in accordance with an embodiment of the present invention.

FIGS. 21, 22, and 23 show a block texture modifying apparatus 300 for modifying the surface texture of blocks 14.

The block-texture-modifying apparatus 300 comprises a support 221 similar to the one described above, a block-texture-modifying assembly 301 and a transitional movement assembly 226 similar to the one described above.

Since, the support and transitional movement assembly 226 have already been described above their description will not be repeated here for concision purposes only.

The block-texture-modifying assembly 302 comprises block-texture-modifying device 304 including a block lifting assembly 308 and a block-chipping device 306 disposed above the displacement surface 224. In another embodiment, the block-texture-modifying assembly 302 may comprise a plurality of block-chipping devices 306.

Block-lifting assembly 308 comprises a roller 236, as previously described, with cam members 238 randomly disposed thereon. The main difference between apparatus block-lifting assembly 308 and 225 previously described is that 300 and block and apparatus 220 is that assembly 308 does not include finger-members 42 and that the roller 236 is so positioned near the opening 234 that the cams 238 protrude therefrom.

The block-chipping device 306 includes a longitudinal rotating member 310, which can spin about an axis X". Member 310 includes a rotary shaft 312 mounted to a rotary actuator 314 powered by a motor 316, via a belt 318 as can be understood by the skilled artisan. Member 310 also includes block-chipping elements 320 in the form of protrusions extending therefrom.

In operation, the blocks 14 are displaced by the displacing assembly 226 along the displacement surface 224 as shown by arrows 4. As the blocks are displaced along the block lifting assembly 308, the roller 236 rotates causing its cams 238 to randomly lift random blocks 14 causing these blocks 14 to engage the protrusion 320. Concurrently, member 310 spins about its axis X" causing protrusion 320 to strike and chip the top surface 15 of any blocks 14 engaged therewith hence, modifying the surface texture of these blocks 14.

FIG. 23 shows a block-chipping assembly 320 in accordance with another embodiment of the invention, and including a block-chipping device 22, as previously described and a block-lifting assembly 308 as previously described. The chipping elements in this case are chain members.

The block chipping assembly 320 includes a hammering device 330 including first and second hammer members 340 and 342 respectively positioned opposite lateral sides. Each hammer member 340 and 342 includes an actuator 344 and a reciprocating arm member 346 mounted at one end to the actuator and having a hammerhead 348 at its other free end.

In operation, the side hammering device 338 will hammer outermost of each the side-by-side blocks 14 at each lateral side 362 and 364 (see FIG. 22) of the displacement surface 302 causing the blocks 14 to hit each other such as shown in portions i, ii, and iii, hence chipping corners and side portions of the blocks 14 as occurs sometimes in conventional block tumblers.

Figure 24:
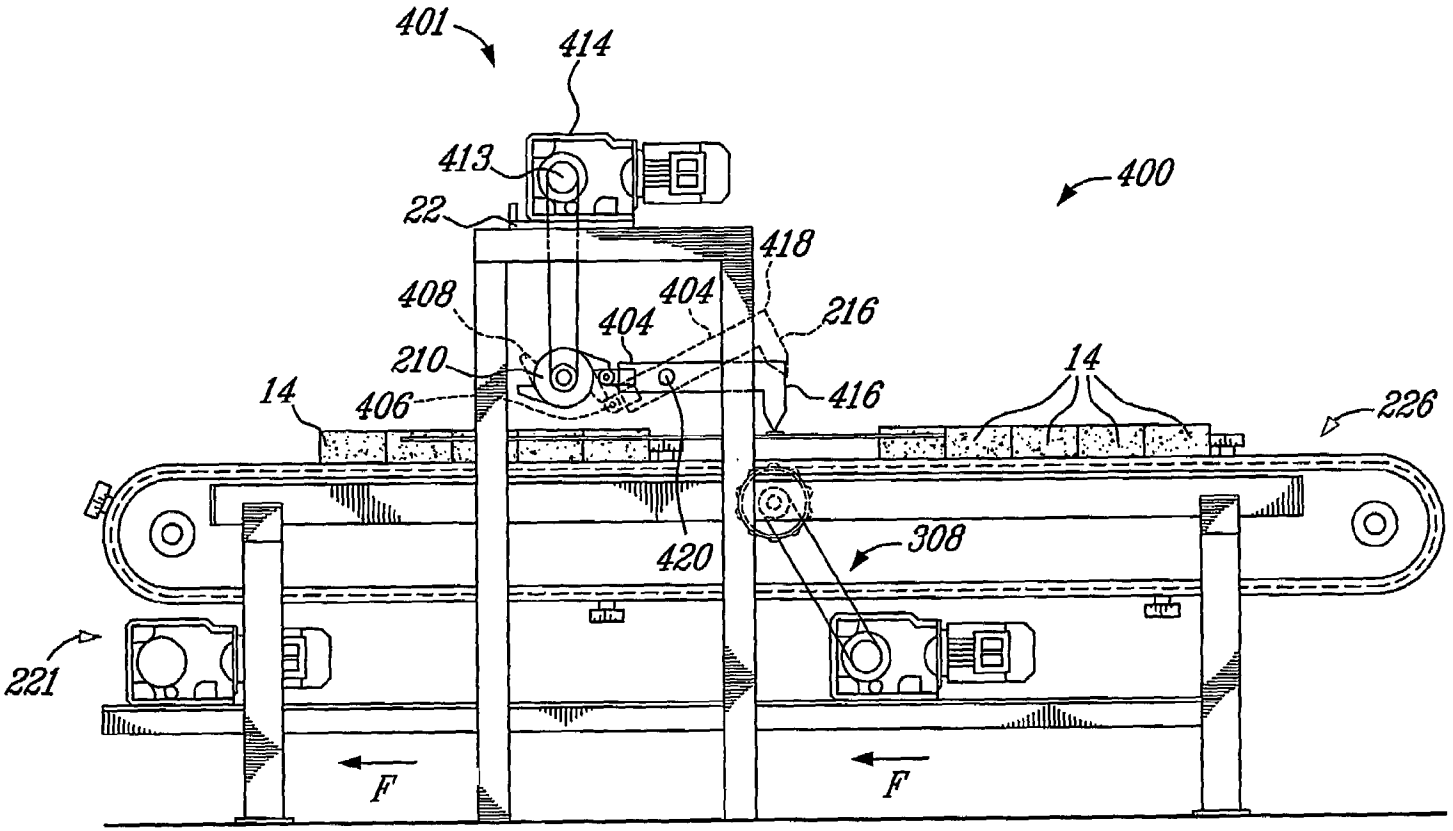
FIG. 24 is a side view of a block-texture-modifying apparatus in accordance with an embodiment of the invention.

FIG. 24 shows a block texture-modifying apparatus 400 for modifying the surface texture of blocks 14.

The block-texture-modifying apparatus 400 comprises a support 221 previously described, a block-texture-modifying assembly 401 which is a block-chipping assembly and a transitional movement assembly 226 previously described.

The block chipping assembly 401 comprises a block-chipping device 402 and a block lifting assembly 308 as previously described. In another embodiment, the block chipping assembly may comprise a plurality of chipping devices 402 and a plurality of block lifting assemblies.

The block-chipping device 402 includes chipping elements in the form of hammering members 404. Each top hammer member 404 includes a back end 406 that is configured to be engaged by the cam members 408 disposed on a longitudinal rotation member 410. This rotating member 410 is mounted via a belt 412 to a rotary actuator powered by a motor 414 to be rolled thereby. The hammers 404 include hammerheads 416 downwardly hanging from the hammer free ends 418 opposite their back ends 406, in this way, giving the hammers 404 an L-shaped configuration.

In operation, the motor 414 will roll member 410 causing the cams 408 to engage the back ends 406 of the hammers 404. The hammers 404 being pivotable about a pivot member 420 will pivot so that their hammerheads 418 are raised. As the cam 410 disengages an end 406 of the raised hammerhead 416, it will drop and strike a block 14 on its top surface 15 displaced thereunder.

Figure 25:
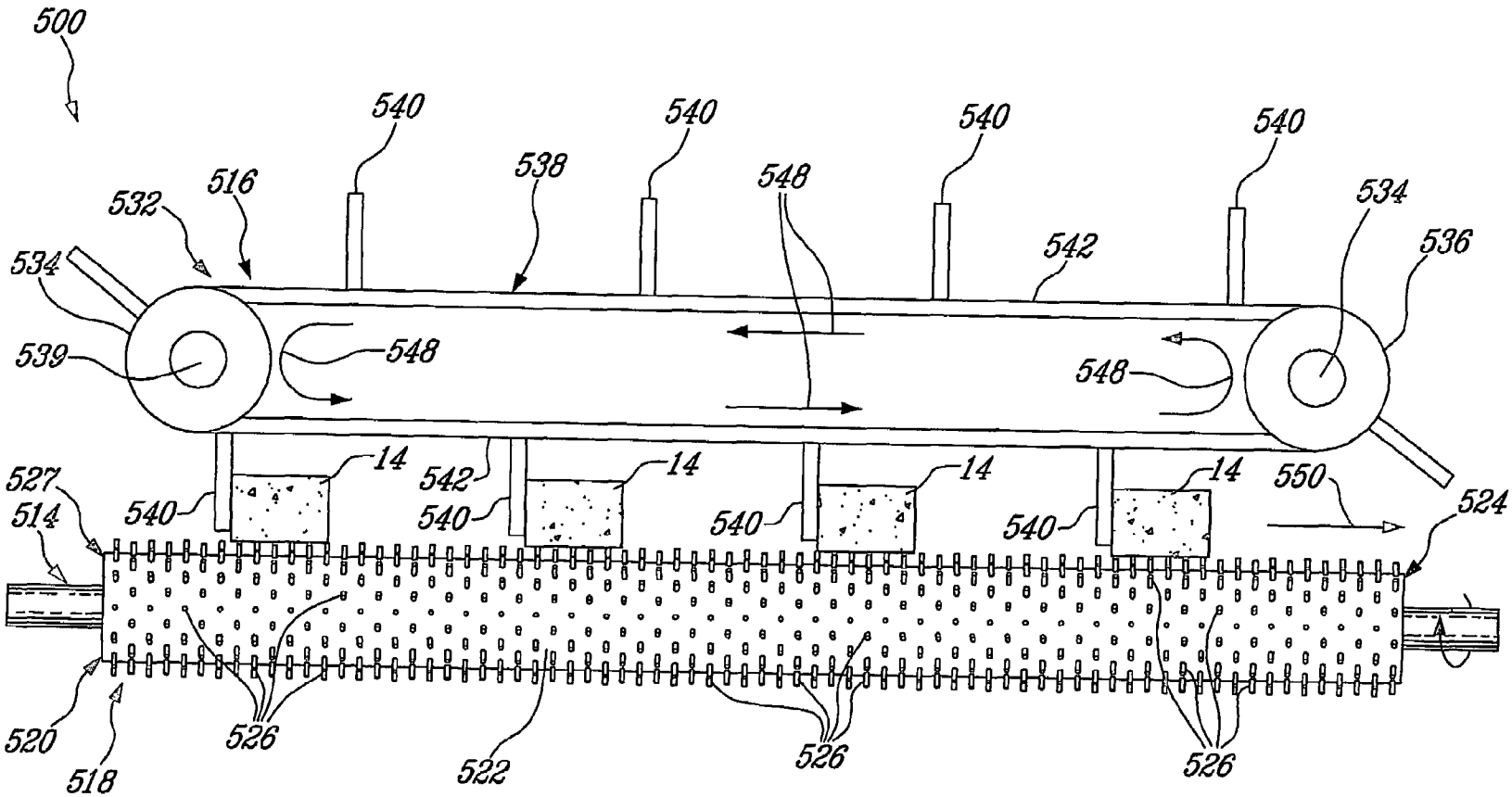
FIG. 25 is a side view a block-texture-modifying apparatus in accordance with an embodiment of the invention.

FIG. 25 shows a block-texture modifying apparatus 500 for modifying the texture surface of blocks 14 in accordance with an embodiment of the invention.

The block-texture modifying apparatus 500 comprises a block-modifying assembly 514 in the form of a block chipping assembly which also acts a support for blocks 14 and a transitional movement assembly in the form block-displacement assembly 516 positioned above the chipping assembly 514.

Figure 26:
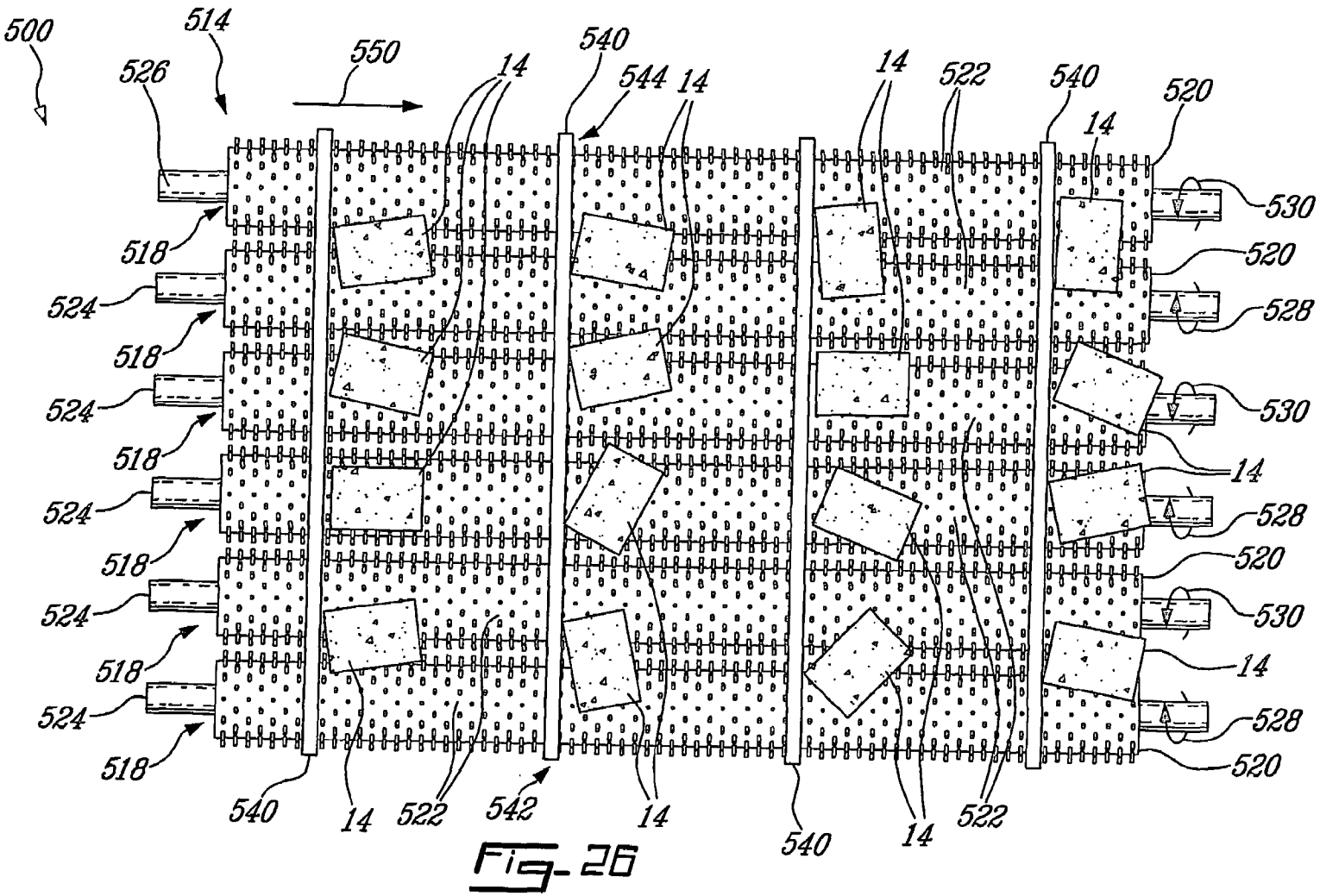
FIG. 26 is a top plan view of the apparatus of FIG. 25.

With reference to FIG. 25 and 26, the chipping assembly 514 may include one or a series of side by side chipping devices in the form rollers 518. Each chipping roller 518 has a chipping surface 522 and includes a rotary-actuator 524.

The rotary-actuator 524 is mounted to a motor (not shown) so as to be actuated to roll about its longitudinal axis in a clockwise direction as shown by arrows 528 or in a counter-clockwise direction as shown by arrows 530.

The chipping surface 522 includes chipping elements such as protrusions 526 and opposite in-feed and out feed ends 527 and 529 respectively. Protrusions 526 are of varying sizes and configurations.

The block-displacement device 516 includes one or a plurality of side by side conveyor 532.

Each conveyor 532 includes a pair of opposite conveyor-rollers 534 and 536 and a conveyor belt 536 mounted about the conveyor-rollers 532 and 534.

Each conveyor-roller 534 and 536 has a central actuator 538 mounted to a motor (not shown) for rotating the rollers 534 and 36 hence, putting the conveyor belt 538 into movement.

The conveyor-belt 538 includes block-engaging elements such as brackets 540 on its outer side 542.

Figure 28:
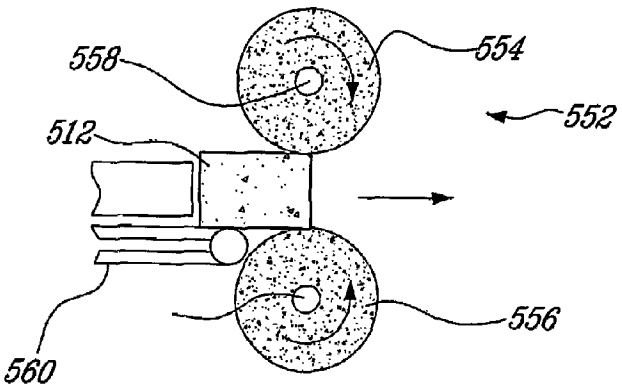
FIG. 28 is a schematic view of an abrading device according to an embodiment of the present invention.

With reference to FIG. 28, the assembly 514 further comprises an abrading device 552. This abrading device 552 includes top and bottom drum rollers 554 and 556 respectively. Rollers 554 and 56 are mounted to respective actuators 558. These rollers 554 and 556 are made of cemententious material and are used to mark or scratch the surfaces of the block 14 that they engage similarly to the way that blocks will scratch or mark each other in conventional block tumblers. Blocks 14 are moved towards rollers 554 and 556 via a conveyor assembly 560.

Figure 27:
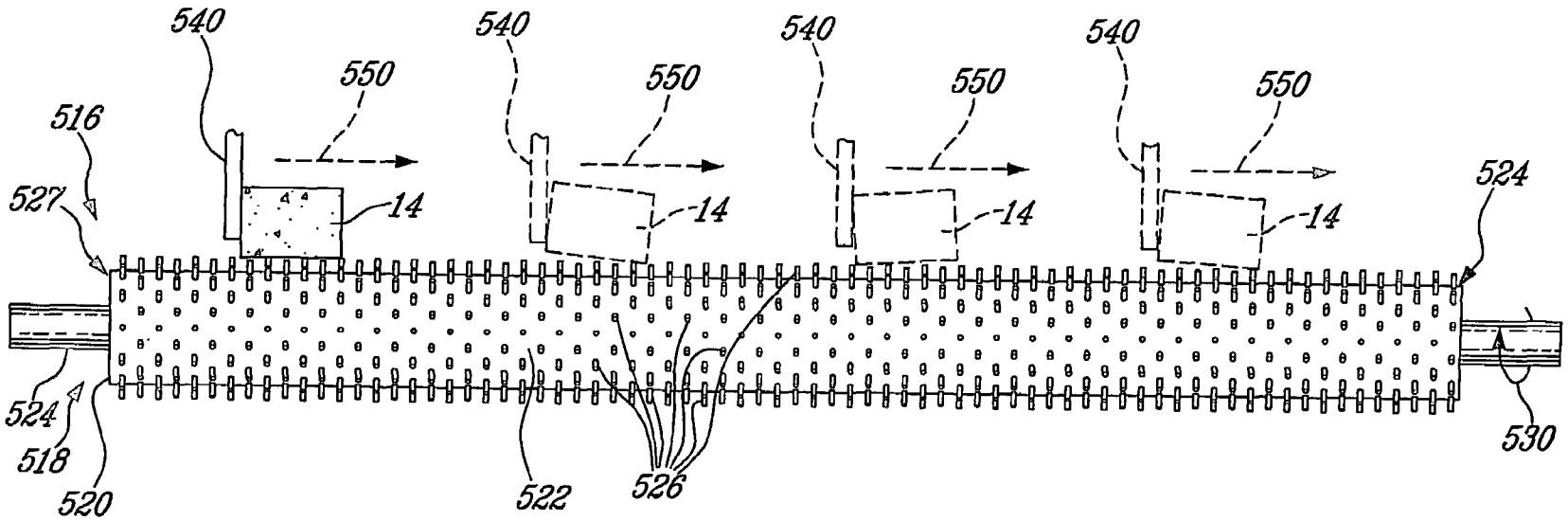
FIG. 27 is a schematic of the apparatus of FIG. 25 showing the translational movement of the blocks along the chipping support displacement surface.

In operation and with reference to FIGS. 25, 26, and 27, the blocks 14 are placed at the in-feed end 527 of the chipping surface 522. As the conveyor rollers 534 and 536 are in operation, the conveyor-belt 538 moves in a counter-clockwise direction shown by arrows 548 moving the block-engaging elements 540 directly above the chipping assembly 514 in the direction shown by arrow 550.

The block-engagement elements 540 displace the blocks 14 along the chipping surface 522 from the in-feed end 527 towards the out-feed end 537 as shown by arrow 550. Concurrently, the chipping-rollers 520 rotate about the longitudinal axis of the roller-actuator 524 in clockwise or counter-clockwise directions as shown by arrows 528 and 530 respectively. In this way, blocks 14 are stumblingly displaced along a varying chipping surface 522 and hence, blocks 14 are randomly hit and chipped by protrusions 526 giving them a natural rock-like allure.

Of course the speed of the rotation of the chipping-rollers 520 can be varied in order to produce deeper chips or lighter chips on the block 510 surface.

When the blocks 14 are recuperated at the out-feed end 527 of the chipping assembly they may be returned in order to chip another surface as is desired by the user.

The blocks 14 may also be passed between rollers 554 and 556 of the block-marketing system 552 in order to for the blocks 14 to be scratched and marked giving them the natural allure that consumers look for.

Keeping the above description in mind, what follows is a brief description without limitation of alternative embodiments of the present block-chipping apparatus 500.

The chipping assembly 514 may include one or a series of side by side different types of chipping devices 518.

A chipping roller 518 may have a generally cylindrical configuration or any other suitable configuration.

The actuator 524 may be mounted to a motor so as to be actuated to move reciprocally about its longitudinal axis.

Figure 29:
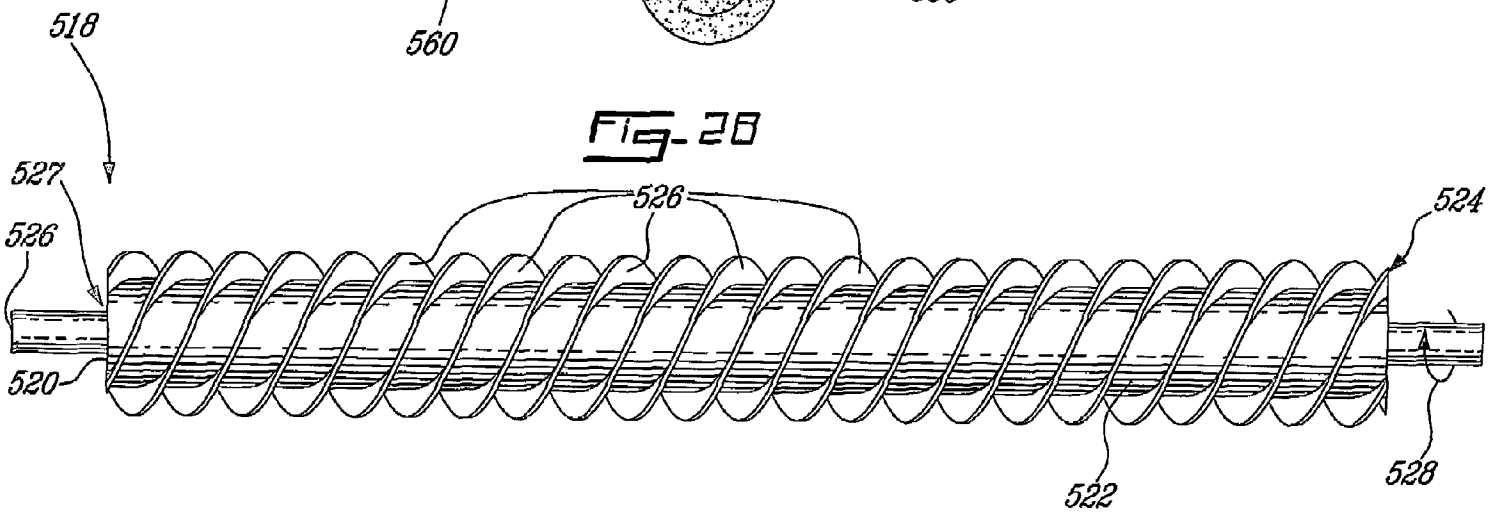
FIG. 29 is a side view of a block-chipping device in accordance with an embodiment of the present invention.

In the illustrated embodiment of FIG. 29, the block chipping elements may be a contiguous spiral thread protrusion 558. In other non-illustrated embodiments, the block chipping elements may be of a variety of shapes and sizes configured to chip blocks 14 as described above. These chipping elements may also be apertures though which air is blown at pressures that are sufficient to chip a block 14. Of course, the same block-chipping surface 522 may include a variety of chipping elements.

The block-displacement assembly 516 may include one or more of side by side block displacement-conveying assemblies of the same or different type as can be contemplated by the skilled artisan.

A variety of block-engaging elements 540 can also be contemplated within the scope of the present invention.

Of course, the present apparatus 500 need not include a surface-marking assembly 552.

In another non-illustrated embodiment that can be contemplated within the scope of the present invention, the chipping assembly 514 may include top and bottom chipping apparatuses. In this respect, the block-displacement assembly 516 may be a block pushing-member for pushing the blocks 14 which are sandwiched between these top and bottom chipping devices from an in-feed end to an out-feed end thereof. Chipping devices that are positioned to chip the sides of the block 14 may also be contemplated within the scope of the present invention.

In another non-illustrated embodiment, yet readily inferable from the present disclosure and drawings, a block-texture-modifying apparatus is provided for modifying the surface texture of blocks 14. The block-texture-modifying apparatus comprises a block-modifying assembly, which comprises superior and inferior sub-block-modifying assemblies, a support, which is defined by the inferior sub-block modifying assembly, and a translational movement assembly.

The inferior sub-block-texture-modifying assembly may be constructed similarly, including variants thereof, to the block chipping devices discussed above for apparatus 500. The superior sub-block-texture-modifying assembly may be constructed similarly to the various block-texture-modifying assemblies disclosed herein that are spaced above the support and block displacement surface which in this case is defined by the inferior sub-block-modifying assembly.

Figure 30:
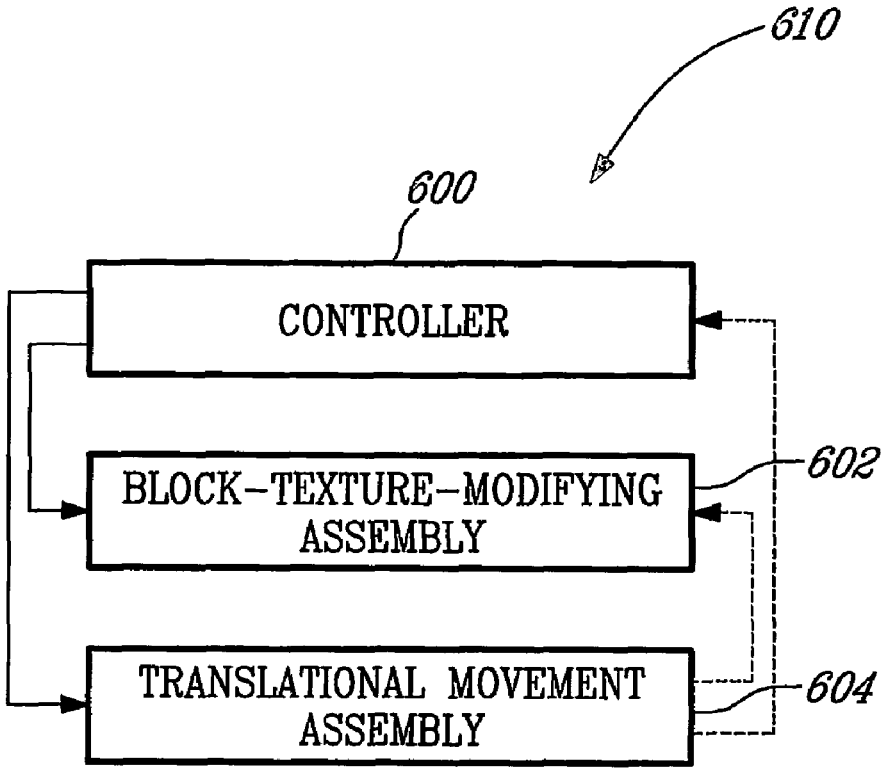
FIG. 30 is a schematic illustration of a system in accordance with an embodiment of the present invention.

As shown, in FIG. 30 all the components of the present invention may be linked to a controller 600 and as such form a block-texture-modifying system 610. The controller may be a data processor such as a computer including an interface such as monitor terminal in order to view the operational activity of the system and allow the user to control this activity via the controller 600. The controller may be pre-programmed to automatically control and regulate the activity of the block-texture-modifying system.

FIG. 30 schematically illustrates the block-texture-modifying system 610, generally denoting the various embodiments as well as sub-components of the block-texture-modifying assembly as 602 and the various embodiments and sub-components of the translational movement assembly as 604.

As such the controller 600 may be linked to various types of actuators that respectively actuate the various components of the invention as can be easily understood by the skilled artisan. The controller may also be linked to sensors, which serve to identify the position of the blocks 14 during the translational movement.

In this way the controller may receive data from the various components of the invention, process this data and transmit a signal to the components for control thereof.

The controller 600 is linked to the foregoing via wiring or by remote control, as is known in the art.

The present invention also provides a method for modifying the surface texture of blocks 14. This method comprises displacing the blocks on a displacement surface such as the surface described herein. The blocks are then impacted with top pressure by way of a variety of the various crunching, abrading, and chipping devices herein for example. The foregoing includes randomly lifting the displaced blocks against this top pressure as described herein. This method also comprises displacing the blocks on a displacement surface that includes chipping elements as described herein. The method may also include submitting the blocks to a side pressure such as with the use of side hammers as described herein.

Of course, the various embodiments or parts thereof described herein may be combined in a variety of ways as can be appreciated by the person having ordinary skill in the art without departing from the scope of the invention.

It is to be understood that the invention is not limited in its application to the details of construction and parts illustrated in the accompanying drawings and described hereinabove. The invention is capable of other embodiments and of being practiced in various ways. It is also to be understood that the phraseology or terminology used herein is for the purpose of description and not limitation. Hence, although the present invention has been described hereinabove by way of preferred embodiments thereof, it can be modified, without departing from the spirit, scope and nature of the subject invention as defined in the appended claims.

What is claimed is:

1. A block-texture-modifying apparatus for modifying the surface texture of blocks, said apparatus comprising:

a block support for supporting blocks thereon;

a block-texture-modifying assembly for engaging and applying pressure to blocks on said support; and a translational movement assembly for providing a translational movement between the blocks on said support and said block-texture-modifying assembly;

wherein said black-texture-modifying assembly is adapted to selectively exert extra pressure on blocks engaged thereby during said translational movement as to modify the respective surface texture thereof, said block-texture-modifying assembly comprises at least one block-texture-modifying device, said block-texture-modifying device comprises a top roller, said top roller comprising ring members, adapted to engage the surface texture of blocks during said translational movement, and said ring-members are so expandable as to selectively exert extra pressure on the surface texture of blocks engaged thereby.

2. An apparatus according to claim 1, wherein said ring members are so spaced apart along the length of said top roller as to engageably receive blocks therebetween.

3. An apparatus according to claim 2, wherein each said top roller comprises at least one pair of adjacent ring-members, said pair of ring-members adapted to engage opposite edges of a given block during said translational movement, said ring-members so acting on the opposite edges of that given block as to crunch them.

4. An apparatus according to claim 1, wherein said top roller is so moveable towards blocks during said translational movement as to selectively apply pressure thereon.

5. An apparatus according to claim 4, wherein said top roller is mounted to a moveable member for being moved towards and away blocks thereby selectively exerting the extra pressure on the texture surface of blocks.

6. An apparatus according to claim 5, wherein said moveable member is mounted to expandable and contractible airpumps.

7. An apparatus according to claim 1, wherein said top roller is powered by an actuator so as to roll about its longitudinal axis.

8. An apparatus according to claim 1, wherein said top roller comprises internal airpumps to expand said ring-members.

9. An apparatus according to claim 1, wherein said block-texture-modifying device comprises a bottom roller including ring-members adapted to engage the surface texture of blocks during said translational movement.

10. An apparatus according to claim 9, wherein said top and bottom rollers include said ring members along their respective lengths.

11. An apparatus according to claim 9, wherein said ring members are so spaced apart along the length of said top roller as to engageably receive the blocks therebetween.

12. An apparatus according to claim 11, wherein at least one of said top and bottom roller comprises at least one pair of adjacent ring-members, said pair of adjacent ring-members of a given said top or bottom roller engaging opposite edges of a given block, said ring-members so acting on the opposite edges of the block as to crunch them.

13. An apparatus according to claim 12, wherein said top and bottom rollers comprise co-linear respective pairs of adjacent ring-members, said top and bottom roller pairs of ring members respectively engaging opposite edges of the top surface and bottom surface of the same given block.

14. An apparatus according to claim 10, wherein at least one of said top and bottom rollers is moveable towards the other of said top and bottom rollers so as to selectively exert extra pressure to the texture surface of blocks engaged thereby.

15. An apparatus according to claim 14, wherein said at least one of said top and bottom rollers is mounted to a moveable member for being moved towards and away the other of said top and bottom rollers thereby selectively exerting the extra pressure on the texture surface of blocks engaged thereby.

16. An apparatus according to claim 15, wherein said moveable member is mounted to expandable and contractible airpumps.

17. An apparatus according to claim 10, wherein said ring-members of said bottom roller are so expandable as to selectively exert extra pressure on the surface texture of blocks engaged thereby.

18. An apparatus according to claim 17, wherein said bottom roller comprises internal airpumps to expand said ring-members of said bottom roller.

19. An apparatus according to claim 9, wherein each said top and bottom rollers are powered by an actuator so as to roll about their respective longitudinal axis.

20. An apparatus according to claim 9, wherein each said top and bottom roller comprises at least one pair of adjacent ring-members, said pair of ring-members of a given said top or bottom roller engaging opposite edges of a given blocks, said ring-members so acting on the opposite edges of the block as to crunch them.

21. An apparatus device according to claim 20, further comprising a plurality of adjacent pairs of said top and bottom rollers, wherein the respective said pairs of ring-members for engaging opposite edges of a given said pair of top and bottom rollers are shifted inwardly relative to the respective said pairs of ring-members for engaging the same opposite edges of an upstream adjacent said pair of top and bottom rollers.

22. An apparatus according to claim 1, wherein said block-texture-modifying assembly comprises a plurality of block-texture-modifying devices positioned along different areas of said support.

23. An apparatus according to claim 1, wherein said translational movement assembly comprises a block-displacement assembly.

24. An apparatus according to claim 23, wherein said block-displacement device comprises a push-member for pushing said blocks along said support, said push-member being powered by a push-member actuator for translational movement thereof.

25. An apparatus according to claim 24, wherein said push-member comprises a proximal end mounted to said push-member actuator and a distal end for engaging and pushing the blocks during said translational movement.

26. An apparatus according to claim 25, wherein said push-member is pivotally mounted to said push-member actuator for pivotal movement thereof.

* * * * *